US010636434B1

(12) United States Patent
Ramprashad

(10) Patent No.: US 10,636,434 B1
(45) Date of Patent: Apr. 28, 2020

(54) JOINT SPATIAL ECHO AND NOISE SUPPRESSION WITH ADAPTIVE SUPPRESSION CRITERIA

(71) Applicant: Apple Inc., Cupertino, CA (US)

(72) Inventor: Sean A. Ramprashad, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/147,301

(22) Filed: Sep. 28, 2018

(51) Int. Cl.

| | |
|---|---|
| ***G10L 21/0232*** | (2013.01) |
| ***H04R 1/40*** | (2006.01) |
| ***H04S 3/00*** | (2006.01) |
| ***G10L 25/84*** | (2013.01) |
| ***H04R 3/00*** | (2006.01) |
| *G10L 21/0208* | (2013.01) |

(52) U.S. Cl.
CPC ..... *G10L 21/0232* (2013.01); *G10L 25/84* (2013.01); *H04R 1/406* (2013.01); *H04R 3/005* (2013.01); *H04S 3/008* (2013.01); *G10L 2021/02082* (2013.01)

(58) Field of Classification Search
None
See application file for complete search history.

(56) References Cited

U.S. PATENT DOCUMENTS

| | | | | |
|---|---|---|---|---|
| 9,503,815 | B2 | 11/2016 | Ramprashad et al. | |
| 2006/0153360 | A1 * | 7/2006 | Kellermann ..... | H04M 9/082 379/406.08 |
| 2007/0172073 | A1 * | 7/2007 | Jang ..... | G10L 21/0208 381/71.1 |

OTHER PUBLICATIONS

Yariv Ephraim & David Malah, "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109-1121.

Y. Ephraim & D. Malah, "Speech Enhancement Using a Minimum Mean-Square Error Log-Spectral Emplitude Estimator", IEEE Transactions on Acoustics, Speech, and Signal Processing, vol. ASSP-33, No. 2, Apr. 1985, pp. 443-445.

* cited by examiner

*Primary Examiner* — James K Mooney
(74) *Attorney, Agent, or Firm* — Womble Bond Dickinson (US) LLP

(57) ABSTRACT

An aspect of this disclosure relates to noise and/or echo suppression for a device in which noise and echo suppression are adaptively determined as noise and echo change in an environment that surrounds the device. An aspect can use a skewed maximal ratio combining technique or a spatial filter with coefficients that are adaptively determined based on a perceptually selected target ratio that is compared to a ratio of sound energies/levels based on a pair of the coefficients. Another aspect relates to the use of information in one frequency band to perform additional noise and/or echo suppression in one or more adjacent frequency bands.

19 Claims, 9 Drawing Sheets

$$g = 1/2 \begin{bmatrix} \sqrt{3} \\ 1 \end{bmatrix} \quad R_{nn} = \begin{bmatrix} 1, & 0 \\ 0, & 3 \end{bmatrix} \quad R_{rr} = \begin{bmatrix} 2, & 1 \\ 1, & 1 \end{bmatrix} \quad \sigma^2 = 5.8 \quad \alpha = 1.0$$

$$g = \frac{1}{2}\begin{bmatrix} 3^{1/2} \\ 1 \end{bmatrix} \quad R_{nn} = \begin{bmatrix} 1, 0 \\ 0, 3 \end{bmatrix} \quad R_{rr} = \begin{bmatrix} 2, 1 \\ 1, 1 \end{bmatrix} \quad \begin{matrix} \sigma^2 = 5.8 \\ \alpha = 1.0 \end{matrix}$$

JOINT SPATIAL ECHO AND NOISE SUPPRESSION WITH ADAPTIVE SUPPRESSION CRITERIA

BACKGROUND

The disclosure relates to processing of audio signals that may include noise and echo and relates to devices that perform this processing.

Echo and noise control are desirable features on modern consumer electronic devices. For example, a number of consumer electronic devices are adapted to receive speech from a near end talker via microphone ports on a first device and transmit a signal representing this speech to a far end device (a second device) and concurrently output audio signals (such as speech from a user of the second device) that are received from the second device. While a typical example is a portable telecommunications device such as a mobile telephone, with the advent of voice over IP, desktop computers, laptop computers and tablet computers may also be used to perform voice communications. Moreover audio systems at home and in the car can also perform voice communications and may use echo and noise control.

In these full duplex communication devices, where both parties can communicate to the other simultaneously, the downlink signal that is output from the loudspeaker may be captured by one or more microphones and get fed back to the far end device as echo. This is due to the natural coupling between the one or more microphones and the loudspeaker; for example the coupling is inherent due to the proximity of the microphones to the one or more loudspeakers on a device. This echo can occur concurrently with desired near end speech and can often render the user's speech difficult to understand. Moreover, the echo of the far end talker can degrade the quality of the communication for the far end talker by distracting the far end talker when the far end talker hears her own voice.

At the same time noise (external to the device and user of the device) in the environment can also degrade the quality of communication. This generally affects all microphones and is independent of (and thus happens concurrently with) echo impairments.

Multiple microphones can be used to help control both echo and noise on a device. While there are techniques that can exploit multiple microphones to do noise control, and there are techniques to exploit multiple microphones to do echo control, how to simultaneously exploit microphones simultaneously for both uses can be tricky. One reason for this is that the impairments due to noise and the impairments due to echo can be different. For example, echo returned to a far-end user is a strong impairment. Here a far-end user can hear his/her own voice which can be very distracting. In extreme cases, this sometimes renders it impossible to talk. Echo returned to the far-end user of course also makes it difficult to understand the near-end user, assuming both users are talking at the same time. In contrast, noise sent to a far-end user mainly impairs the far-end user's ability to understand the near-end user. It does not necessarily distract the far-end user to the point of not being able to talk.

SUMMARY OF THE DESCRIPTION

An aspect of this disclosure relates to noise and/or echo suppression for a device in which noise and echo suppression are adaptively balanced as noise and echo change in an environment that surrounds the device. An aspect of this disclosure can use a modified (skewed) maximal ratio combining technique with coefficients that are adaptively skewed and determined based on a perceptually selected target ratio. Thus the technique does not simply maximize SNR (Signal to Noise Ratio) or consider noise as simply the sum of echo and noise energies, as a generic SNR optimizing technique would. Rather the technique can skew the balance between noise and echo using spatial dimensions to suppress noise verses suppressing echo. For example, the technique can skew the balance between different signal components using spatial dimensions to unequally target the suppression of noise relative to suppression of echo. Underlying the algorithm driving this balance are comparisons of ratios of sound energies or levels. For example, according to one aspect of this disclosure, a data processing system can include: a plurality of microphones to provide a multichannel signal representing sound that is comprised at least one of noise, speech, or echo; one or more speakers to output sound; a processing system coupled to the plurality of microphones and coupled to the one or more speakers; a memory to store executable program instructions which when executed by the processing system because the processing system to perform a method which can include the following operations (A) receiving the multichannel signal; (B) determining a first value and a second value to suppress at least one of echo or noise, the first value to affect an amount of suppression of echo for the multichannel signal and the second value to affect an amount of suppression of noise in the multichannel signal, the first value and the second value being determined adaptively over time based on the multichannel signal; and (C) generating a spatial filter and a spatial filtered output using the first value and the second value, the spatial filtered output producing a single channel output derived from the multichannel signal, and the spatial filtered output suppressing at least one of noise or echo. According to one aspect, the spatial filtered output can be produced by a skewed maximal ratio combining component or a formulation that uses the first value and the second value. According to one aspect, the first value and the second value can be adaptively determined based on a ratio of (1) a sum of an estimated speech level signal and an estimated noise level signal to (2) an estimated echo signal level. According to one aspect, the ratio can be determined as a function of the first value and the second value, and the first value and the second value can be determined based on a comparison of the ratio, for a pair of the first value and the second value, to a target ratio of signal levels. The target ratio can be perceptually determined and selected to suppress echo more than noise and in one aspect this ratio has a perceptual meaning and can be between 6 to 20 dB, which is often the range of what a masker signal (e.g., a signal used to mask another signal) must exceed another signal to have an effect on its perceived loudness. According to one aspect, the first value can be a coefficient that scales an assumed noise covariance matrix and the second value can be a coefficient that scales an assumed residual echo covariance matrix; the assumed noise covariance matrix and the assumed residual covariance matrix can be combined and used by the skewed maximal ratio combining technique to generate the spatial filter and the spatial filtered output. According to one aspect of this disclosure, the method can further include the operations of: (a) determining, for a set of frequency bands, a set of sound data derived from the spatial filtered output for each of the frequency bands in the set of frequency bands, wherein a set of sound data for a first frequency band includes a first level of estimated noise and a first level of estimated echo and a first level of estimated speech and a set of sound data for a second frequency band includes a second level of estimated noise and a second level of estimated echo and a second level of estimated speech; (a) selecting the set of sound data for the first frequency band for use as a first reference, the selection based on a comparison of the first level of estimated noise and the first level of estimated echo relative to the first level of estimated speech; and (c) determining at least one of an additional noise or echo suppression for the set of sound data for the second frequency band based on the first reference and wherein the first frequency band is adjacent to the second frequency band in the set of frequency bands. In one aspect of this disclosure, a noise suppression target can be reduced in low signal to noise ratio conditions to improve echo suppression.

Another aspect of this disclosure relates to the use of information in one frequency band to perform additional noise and/or echo suppression in one or more adjacent frequency bands. For example, according to one aspect, a data processing system can perform a method which includes: (a) determining, for a set of frequency bands, a set of sound data derived from a spatial filtered output for each of the frequency bands in the set of frequency bands, wherein a set of sound data for a first frequency band includes a first level of estimated noise and a first level of estimated echo and a first level of estimated speech, and a set of sound data for a second frequency band includes a second level of estimated noise and a second level of estimated echo and a second level of estimated speech; (b) selecting the set of sound data for the first frequency band for use as a first reference to determine at least one of noise suppression or echo suppression, the selection being based on a comparison of at least one of the first level of estimated noise and the first level of estimated echo relative to the first level of estimated speech; and (c) determining at least one of a noise suppression or an echo suppression for the set of sound data for the second frequency band based on the first reference. According to one aspect of this disclosure, the at least one of the noise suppression or the echo suppression is an additional suppression performed after at least one of an echo suppression or a noise suppression by at least one of (1) a skewed maximal ratio combining component or a skewed spatial filter and (2) a coherent suppression of at least one of noise or echo. According to one aspect, the maximal ratio combining component can use a first coefficient and a second coefficient that are adaptively determined based on changing noise or echo in an environment surrounding the data processing system.

Aspects of this disclosure recognize that a difference between how echo and how noise can impair a communication session (such as a phone call) should be taken into account when suppressing noise and echo. As noted above, echo can be highly disruptive, especially echo returned to the far end user. This difference, and even asymmetry in impairment in some cases, should be balanced in aspects of a multi-microphone signal enhancement technique in a perceptually intelligent way. Often this means going beyond the basic objectives of adaptive schemes used by many multi-mic processing algorithms. These are often formulated to do straight-forward things like maximizing a Signal to Noise Ratio (SNR), as a Weiner filter or Minimum Variance Distortionless Response Filter may do. Aspects in this disclosure can use algorithms which adaptively move between these designs and other designs as noise and echo characteristics change and the perceptual goal is influenced by asymmetries in goals and impairments.

Another aspect considered in this disclosure is that suppression of a signal at a given time in a given frequency band can affect all components of the signal, i.e. the desired speech, the noise, and the echo, at a given time in a given frequency band. Certainly for systems with a single microphone the application of suppression, which is a simple gain that attenuates the signal in a given time and/or frequency interval, applies to all components equally. For multi-channel systems the use of multiple (spatial) dimensions allows one to be more careful by allowing one to suppress some dimensions more than others, as in MVDR and Maximal Ratio Combining. However, in general, and other than extreme cases where signal components are orthogonal in the multi-dimensional space, suppression affects all components to some degree since the spatial components of speech, echo and noise interact.

To be more effective in signal enhancement, for example to render echo and noise less objectionable, aspects of this disclosure can take advantage of situations where the desired signal can act as a masker of both echo and noise. By masker it means that the perceived loudness of echo and noise is less when there is desired signal present and the desired signal is both close in time and frequency of echo and noise. Furthermore noise also acts a masker of echo. Thus, suppressing signal and/or suppressing noise can render echo more or less perceptible, or in other words, perceptually more or less loud. There is therefore a careful balance for aspects described herein between any suppression algorithm and its effect on these three signal components.

The aspects described herein can be performed by general-purpose processing devices or by special-purpose hardware processing devices. Further, the aspects described herein can also include non-transitory machine readable media that store executable computer program instructions which when executed by one or more data processing systems cause the one or more data processing systems to perform the one or more methods described herein. The non-transitory machine readable media can include nonvolatile storage such as flash memory and other forms of memory such as volatile DRAM (dynamic random access memory).

The above summary does not include an exhaustive list of all aspects in this disclosure. All systems and methods can be practiced from all suitable combinations of the various aspects summarized above, and also those disclosed in the Detailed Description below.

BRIEF DESCRIPTION OF THE DRAWINGS

The present invention is illustrated by way of example and not limitation in the figures of the accompanying drawings.

DETAILED DESCRIPTION

Figure 1:
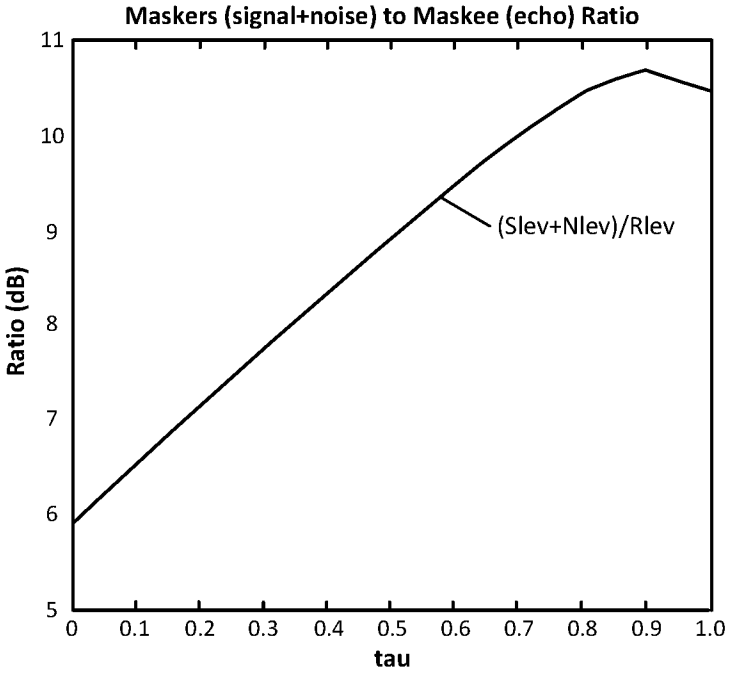
FIG. 1 shows two graphs that depict a method for selecting a value (tau) for controlling the balance between noise and echo suppression according to one aspect described herein.
Figure 1:
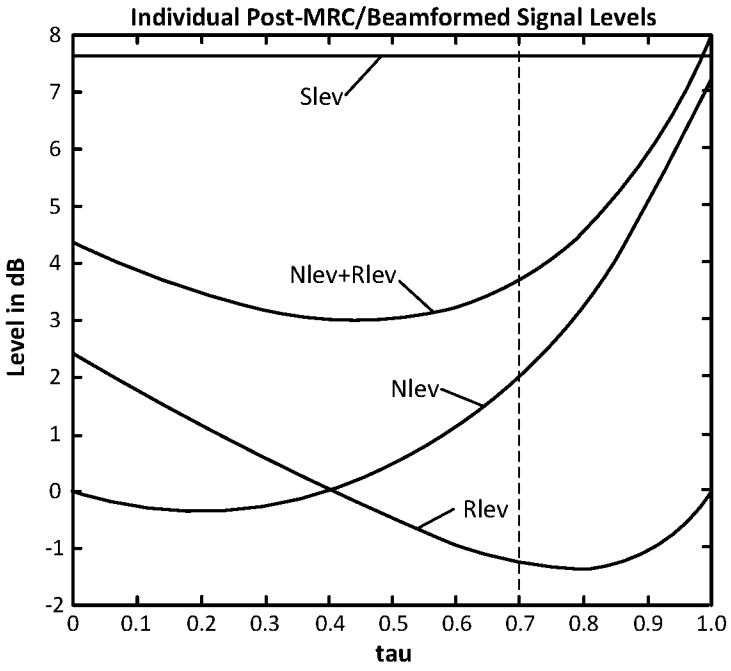

Various systems and aspects will be described with reference to details discussed below, and the accompanying drawings will illustrate the various aspects. The following description and drawings are illustrative and are not to be construed as limiting. Numerous specific details are described to provide a thorough understanding of various aspects. However, in certain instances, well-known or conventional details are not described in order to provide a concise discussion of aspects.

Reference in the specification to "one aspect" or "an aspect" means that a particular feature, structure, method or characteristic described in conjunction with the aspect can be included in at least one implementation. The appearances of the phrase "an aspect" in various places in the specification do not necessarily all refer to the same aspect. The processes depicted in the figures that follow are performed by processing logic that comprises hardware (e.g. circuitry, dedicated logic, etc.), software, or a combination of both. Although the processes are described below in terms of some sequential operations, it should be appreciated that some of the operations described may be performed in a different order. Moreover, some operations may be performed in parallel rather than sequentially.

Suppressors, e.g. noise suppressors and residual-echo suppressors, form an important part of voice and audio processing chains used in applications such as real-time voice communication and voice recognition. These suppressor units often operate after more coherent cancellation/noise reduction techniques, such as linear echo cancellers, are used. They are used to further improve the quality beyond that which can be attained by coherent techniques alone.

A set of "targets" (or goals) for echo suppression and noise suppression can be quite different, with the former being more about the perceptual detectability or recognition of suppressed residual-echo and the latter being more about general SNR (Signal to Noise Ratio) improvement without necessarily rendering suppressed noise imperceptible. How to balance these targets, both in single-channel and multi-channel systems, is addressed in this disclosure.

Coherent techniques operate with more detailed knowledge of the signal. In particular both spectral gain and spectral phase information is assumed known about the signal components a coherent technique is trying to control or modify. Thus coherent processing is often preferred and used initially in a chain as they allow for better control of undesired components with minimal distortion to desired components.

Unfortunately, in practical scenarios perfect knowledge of aspects such as the joint gain and phase of a signal component is often not available, and coherent techniques on their own often cannot meet performance targets. Thus non-coherent techniques, such as suppressors, which rely on less information, can be used to additionally process signals.

In aspects described in this disclosure, a suppressor can have information about either long-term average power spectra or long-term average "covariance" information, or some rough approximation thereof, for undesired components such as noise or residual-echo. One can also know the instantaneous power of the input multi-channel signal which provides some additional "instantaneous" a-posteriori information. Aspects of this disclosure leverage spatial information through use of multiple signals (such as signals from multiple microphones placed in different locations on a device).

Specifically aspects of this disclosure consider how such a system operates when the signal(s) being operated on are multi-channel signals. For example, a voice processing chain, in a speech communication or voice-recognition system, may be driven by signals originating from multiple microphones. In such a system the signals can be initially processed by the coherent system, e.g. by multiple individual echo cancellers, or non-adaptive components like equalizers, and then the suppressors are presented with multiple post-coherently-processed signals. These multiple signals can include the processed microphone signals as well as additional signal-components that can be estimated, such as linear echo estimates. The suppressors can then use all these signals to produce one or more suppressed signals.

It is known that both noise suppression and residual-echo suppression can benefit from the joint processing of multiple signals driven by multiple microphones. For example, if unwanted noise comes from a dominant spatial direction (relative to the microphone array), and the signal of interest (e.g., speech) comes from another direction, then the noise suppressor can weigh and combine signals from different microphones in different spatial directions to improve the output signal to noise ratio. It is also true under even more basic assumptions. For example, if in a very basic first-order sense the multiple microphones provide signals at different signal to noise ratios (SNRs), say by their relative placement to different sources, and if the noise is not coherent across such microphones, then signals can be weighed and linearly combined to produce a joint signal with higher SNR than any individual signal.

This is also true about residual-echo reduction. This is a classic diversity gain that can be exploited in both in acoustics and wireless systems.

More will be said later but a classic technique (formulation) used is that of a Minimum Variance Distortionless Response (MVDR) Beamformer. For the purpose of this disclosure it is useful and important to realize that this MVDR beamformer is actually a combination of two techniques:

a) A beamformer, and b) A Maximal Ratio Combining (MRC) operation.

The latter technique (MRC) is an aspect of the multi-channel noise reduction/suppression which exploits the diversity of multiple streams. In fact, these techniques can be used without the "Distortionless" constraint in more general suppression systems.

While a system can simply and directly apply the original MRC formulation (or any existing suppressor system) to the suppression of the total undesired signal, in this case the "total undesired signal" being simply the sum of noise and residual-echo, the result of such a direct application is often not perceptually desirable.

Often this "direct" approach is what is done, and differentiation of noise and echo suppression comes in when limiting the "net suppression gain" of such a process in an asymmetric manner depending on the proportion of noise or residual-echo in a signal. This differentiation is a crude way to say "suppress echo more". But, again, often this "just suppress residual-echo more" when there is more residual-echo does not lead to a desired result.

In considering what a "desired result" should be there are four things to note:

a) In a crude sense, noise and echo suppression often operate under different criteria with different (unequal) suppression targets, often with echo suppression being more aggressive, as just noted.

b) Ultimately, the targets of residual-echo suppression and noise suppression are different.

In the case of residual-echo, the criteria is often a perceptual criteria of rendering the suppressed residual-echo imperceptible or unrecognizable as echo. In other words, residual-echo (and noise and desired speech) should be suppressed in a way as to allow the residual-echo to be masked by other components.

In contrast, in the case of additive noise the criteria is often one of simply reducing the noise level (improving SNR) while balancing the distortion on the speech.

c) When spatial processing is considered, a system can also use an unequal balance of noise and residual-echo control in such spatial processing. In particular, noise and residual-echo spatial suppression should be balanced to achieve a post spatial filtered signal where desired speech and noise are in a better balance relative to residual-echo in order to enable better control of the perceptibility of suppressed residual-echo.

d) Residual-echo is generally not stationary. The noise to be suppressed is often assumed stationary, with more non-stationary "transient" components (e.g. a dog barking or horn blowing) passing through the system as if it were speech (there are techniques to detect certain "transients" and react, but this general statement is true). Thus, a system can model residual-echo to reflect this non-stationary nature and this is an aspect described herein.

Highlighted Aspects

Several aspects will be highlighted below.

1. A covariance matrix used in the formulation of a modified and skewed maximal ratio combining (MRC) operation of an aspect of the system can be formulated using an unequal weighting of assumed covariance matrices, in particular covariance matrices of assumed noise and residual echo.

2. This unequal weighting can be fixed. However, in one aspect, this unequal weighting is adaptive, changing with prevailing conditions of noise and conditions of residual-echo which are in general not stationary in many scenarios. The weighting can be formed from information derived from the individual-assumed noise and residual-echo covariance matrices and the estimated post-spatial filtered levels of speech, noise and residual-echo with respect to different weighting values. These post-spatial filtered levels can drive an unequal weighting that is used to drive towards targets of the relative-level of desired speech, noise, and residual-echo after suppression.

One implementation can use a target ratio of energies. Another more elaborate implementation uses masking and the perceived loudness of the unmasked post-processed residual-echo in the presence of speech and noise. As the non-stationary nature of residual-echo changes, e.g. as residual echo is present or not, or as the level and spatial signature changes, the system can, according to one aspect, naturally adapt. The same is true if the characteristics of noise change.

3. According to one aspect, the assumed covariance matrix of the residual-echo can be made up of a long-term average covariance added to an instantaneous matrix. This instantaneous matrix can be directly formed from another long-term estimated coherent measure (e.g. leakage) multiplied by a matrix that is a function of instantaneous linear-echo estimates from an echo canceller (or reference signals in the playback creating the echo).

4. The post-spatial filter operation of the system according to an aspect is a single-channel suppressor system that is driven by quantities derived in the multi-channel system. These quantities can include post-spatial filtered signal levels as well as masking levels. This single-channel suppressor system can consider the masking that acts on post-spatial filtered post-suppressed residual-echo, and this approach allows noise-suppression gains and residual-echo suppression gains to be combined in a way that makes sense from the point of view of the different goals of each.

It also allows a system to "back off" on noise suppression targets if/when it will help mask residual-echo more effectively, and thus helps avoid simply gating the signal which happens in current systems where noise suppression and residual-echo suppression are not property balanced and coordinated.

In another aspect, a system can use an additional post-filter in part derived from a modified formulation of amplitude estimation of Ephraim and Malah. The formulation notes that the original Ephraim and Malah system is in fact a combination of a classic Wiener filter and a "correction factor". This "correction factor" can either additionally boost or suppress a signal depending on how the measured (instantaneous) SNR compares to the (a-priori) expected "average" SNR. This hybrid system can combine the new masking driven perceptually biased-Wiener filter (not the basic Wiener filter component of the Ephraim and Malah system) with just the original correction factor.

5. According to one aspect, a goal of a system is to reduce noise while rendering residual-echo as imperceptible or unrecognizable as possible. This can be done by an unequal handling of noise and residual-echo through the use of a spatial suppressor as described herein. This spatial suppressor can leverage multiple channels get closer to this target with less desired-signal distortion. In addition, by using masking considerations more directly, both in the multi-channel processing and subsequent single-channel suppression, a system can achieve better sounding desired speech. While a log-spectra minimization such as Ephraim and Malah's technique is useful, and a system can use it for some of the noise suppression according to an aspect of the disclosure, ultimately this approach is less applicable to residual-echo suppression and its underlying goal. In linking this post-spatial filter operation to single channel perceptually-biased Wiener-like suppression, the system can drive towards masking targets while balancing expected levels of signal, noise and residual-echo. This tends to achieve a more pleasing result in perceptual quality.

Note, many prevailing techniques lump the residual-echo and noise together as a total noise source. Differentiation between the two is achieved by setting a suppression-gain limit which weighs individual limits for noise and residual-echo based on the proportion of both in this "total noise". For example, a gain driven by noise suppression may be limited to −12 dB, while a gain driven by residual-echo suppression may be limited to −70 dB. When both noise and residual-echo are present the system uses something in between.

But in doing so there is really no concept of masking, and certainly useful portions of "noise" that help in masking echo could be unduly suppressed. The result is that often a noise suppressor, or a residual echo suppressor, or some combination thereof, result in signals where residual echo is quite perceptible. When this happens the system has a final option to simply "gate" (drive to zero, or near zero) the level of the signal. This is the situation that should be avoided as the far-end caller will not hear the near-end caller.

This may be unavoidable, of course, if the system is operating under very low SNR and with no sufficient masking signals present to hide the residual-echo. For example, if the SNR is low because the residual-echo is high, and really there are no useful maskers, the system may have no option except to gate. However, if the SNR is low because noise is high, and a system is successfully masking many residual-echo components, a better result would be to maintain or improve that masking while minimizing noise further. According to one aspect in this disclosure, noise suppression targets can be refined (in particular reduced) to help aid in the additional masking of residual echo.

Background Aspects

There are a number of different techniques and systems which can be used in the various aspects described in this disclosure. Much of these systems use different covariance matrices to drive different MRC operations followed by an analysis of post-spatial filtered levels of signal components with respect to the different MRC formulations. This is an aspect of the multi-channel nature of a system described herein as it exploits spatial dimensions (directions) to both suppress and balance relative levels of the desired signal, noise, and residual-echo after joint multi-channel suppression. It is good to review the techniques and define terminology before describing these various aspects and systems.

Review of Beamforming and Maximal Ratio Combining for Noise.

A classic way to exploit multiple signals in improving signal to noise ratio is via a Minimum Variance Distortionless Response (MVDR) Beamformer. This is actually a combination of two techniques: a) A beamformer, and b) Maximal Ratio Combining. It is worth considering this breakdown in this disclosure.

At the heart of this classic MVDR design is another classic technique, a Maximal Ratio Combining (MRC) operation, which exploits diversity in the noise components. In a MVDR beamformer this is done by looking at the different eigenspaces of an assumed noise covariance matrix.

Assume that a system receives an N-dimensional signal $y=[y_1, \ldots, y_N]^T$ derived, for example, from some coherent processing on N microphone signals. This signal y can be at a given time or frequency bin.

One component of this signal y is noise n, which is also a N-dimensional vector $n=[n_1, \ldots, n_N]^T$. The covariance of the noise is defined by a N×N matrix $R_{nn}=E[nn^H]$ where the assumption is that noise is stationary, and so such a covariance matrix makes sense. Here "E[ ]" denotes expected value.

There are many techniques to do this "expectation" to estimate this matrix in practice, e.g. exponential recursively averaging actual signals $yy^H$ when it is known that only noise is present, that is when no desired speech or residual-echo is present, or additionally weighing the recursive update by a soft-value as a speech presence probability. These techniques are well-known to those familiar with the state of the art and can be used in one or more implementations.

This matrix can be written in an eigenspace breakdown as $$R_{nn}=E_nD_nE_n^H,$$

where $E_n$ is a unitary matrix of orthonormal (unit norm and orthogonal) eigenvectors $[e_1, \ldots, e_N]$ of $R_{nn}$, and $D_n$ is a diagonal matrix of positive eigenvalues $[d_1, \ldots, d_N]$ of $R_{nn}$. Note $$E_n^H=E_n^{-1}$$

$$E_n^HE_n=I$$

given $E_n$ is a unitary matrix, and a multiplication by $E_n^H$ is actually a transformation into the eigenvector basis of the N dimensional space.

Conversely, a subsequent multiplication by $E_n$ is a transformation back into the original space.

The useful interpretation of this breakdown is that the noise "lives" in primary directions defined by the eigenvectors $[e_1, \ldots, e_N]$, and the expected power of the noise in direction $e_k$ is $d_k$. This interpretation is well understood by those familiar with the state of the art.

We now consider an unequal weighting of these noise directions when the system is presented with an input signal $y=[y_1, \ldots, y_N]^T$. The process in MRC is:

1. The process breaks the signal down into different eigen-directions via a matrix multiply $y_e=E_n^Hy$.

2. The process unequally weights each direction "k" by $(1/d_k)^{1/2}$ via $y_{wn}=D_n^{-1}y_e=D_n^{-1/2}E_n^Hy$, where the "wn" in $y_{wn}$ means weighted direction with respect to noise n.

3. The process maps the signal back into the original direction via a matrix multiply $y_{mrcn}=E_ny_{wn}=E_nD_n^{-1/2}E_n^Hy$, where the "mrcn" in $y_{mrcn}$ means maximal ratio combined y with respect to noise n.

The beamforming part of the process considers a model where the signal lives in a direction g. We assume this direction is of unit norm.

The N-dimensional signal s(t) of interest s(t) can be thought of as a scalar value h(t) multiplied by this vector, i.e. s(t)=h(t) g. We assume $$E[\|s(t)\|^2]=E[\|h(t)g\|^2]=E[\|h(t)\|^2]E[\|g\|^2]=E[\|h(t)\|^2]=\sigma^2.$$

To beamform the MRC weighted noise one also performs MRC weighting on the direction vector g. We have $g_{mrcn}=E_nD_n^{-1/2}E_n^Hg$. When we apply this MRC-ed beamformer to the MRC-ed input we have:

$$\text{Output}=g^H_{mrcn}y_{mrcn}=(g^HE_nD_n^{-1/2}E_n^H)(E_nD_n^{-1/2}E_n^Hy)=g_HE_nD_n^{-1}E_n^Hy=g^HR_{nn}^{-1}y$$

Here one can think of the beamformer operating on y as a vector $R_{nn}^{-1}g$. This is a classic operation seen in many formulations of multi-channel processing that maximize output signal to noise ratio.

Thus, it is also at the heart of the MVDR formulation. Here the "Distortionless" part of the MVDR formulation specifies a scaling of this output so that if y=h(t)g, that is for an input which has no noise or echo, the output of the MVDR beamformer has an expected value αh(t).

This could be, for example $\alpha h(t)=h(t)y_k$, which preserves the phase and gain of the k-th component of the input y to the process.

To achieve this a we add a scaling to $R_{nn}^{-1}g$ to achieve a net filter $q_n$ for noise reduction defined by $$q_n=\alpha R_{nn}^{-1}g/(g^HR_{nn}^{-1}g)$$

Later, for convenience we will define a term $\lambda_{nn}=g^H R_{nn}^{-1}g$

Beamforming and Maximal Ratio Combining for Echo and Differences

We can consider a similar formulation for echo for a residual-echo signal r. We can replace the covariance matrix $R_{nn}$ with one for echo R, $=E[rr^H]\cdot c$ With this we can define a filter $q_r=\alpha R_{rr}^{-1}g/(g^H)$. However, unlike noise, residual-echo can often not be considered stationary, and so it may not be amenable to direct application of recursively averaged estimates as with noise. For example, the residual-echo of echo which was originally speech often sounds like such speech, even to the point of being understandable. As such a covariance matrix defined by a statistical expected value $R_{rr}=E[rr^H]$ is not necessarily applicable. Later we will present some different structures which have proven to be useful.

Spatial Filtering with a Different Covariance Matrix

Taking the case of MVDR (or equivalently MRC with beamforming with a scale factor) for the case of signal plus noise (no echo) we know from the formulation that the spatial filter $q_n$, or even a scaled version of it, chives the best possible expected output signal to noise ratio. This is because the spatial filter $q_n$ is formed by using the covariance of the noise $R_{nn}$ as previously described. However, according to another aspect of this disclosure, a goal of an implementation of a system is not to simply maximize SNR but to balance the action of such a filter on different signal components. According to an aspect of this disclosure the spatial filter can use an assumed covariance matrix that is not a covariance of the underlying signal we want to reduce. Specifically, it is not simply the covariance of the noise or the sum of the covariance of the noise plus the covariance of the echo. Therefore what a system can do here is no longer simply Maximal Ratio Combining.

Assume we use a covariance estimate $R_{uu}$ for some "yet to be defined" signal u made up of noise, echo or combination of both. $R_{uu}$ does not even have to relate to the covariance of any signal, it can simply be an arbitrary symmetric positive semi-definite matrix (a symmetric matrix where $R_{uu}=R^H_{uu}$ with positive eigenvalues).

In formulating the spatial filter a system can still use a beamformer direction, which can remain g as this is inherent to the desired signal.

In one aspect, a system can formulate a spatial filter using $R_{uu}$ and the expected power of the spatially filtered noise is now given by:

$$=\alpha_2\{g^H R_{uu}^{-1}E[n(t)n^H(t)]R_{uu}^{-}g\}/(g^H R_{uu}^{-1}g)^2$$

$$=\alpha^2\{g^H R_{uu}^{-1}R_{nn}R_{uu}^{-1}g\}/\lambda_{uu}^2 \text{ where } \lambda_{uu}=g^H R_{uu}^{-1}g.$$

Certainly, if one used $R_{uu}=R_{nn}$ then the post-spatial filtered SNR achieved can be improved. But one aspect of this disclosure shows that a system that does not use this "best" value, achieving the best post-post-spatial filtered SNR, can be desirable, particular in situations where noise can be used to help mask echo.

Note, in a similar way, if we assumed the noise and residual-echo are independent and uncorrelated, and together form a joint noise source v then we have $$v=n+r$$

$$R_{vv}=E[(n+r)(n+r)^H]$$

$$=E[nn^H]+E[rr^H]+E[nr^H]+E[rn^H]$$

$$=E[nn^H]+E[rr^H]$$

$$=R_{nn}+R_{vv}$$

Here a system can form a spatial filter with $R_{uu}=R_{nn}+R_{vv}$ which would allow for the best possible post-spatial filter signal to total noise and echo ratio. But, again, this is not the intention in at least some aspects since it does not achieve the desired effect.

$$q_v=\alpha R_{vv}^{-1}g/(g^H R_{vv}^{-1}g)$$

$$\lambda_{vv}=(g_H R_{vv}^{-1}g)$$

As with noise, for any given value of $R_{uu}$ the expected power of the spatially filtered echo is given by:

$$=\alpha_2\{g^H R_{uu}^{-1}E[r(t)r^H(t)]R_{uu}^{-}g\}/(g^H R_{uu}^{-1}g)^2$$

$$=\alpha^2\{g^H R_{uu}^{-1}R_{rr}R_{uu}^{-1}g\}/\lambda_{uu}^2.$$

The various aspects of this disclosure will now be described in three parts, which include examples of equations, methods, systems, and operations performed by such systems.

The first part will describe how to drive/define the spatial filter operation towards a better use of spatial dimensions for joint noise and residual-echo suppression. In particular it will describe how to define the matrix "$R_{uu}$" used in the formulation of the spatial filter, and how to take into account perceptual targets in residual-echo suppression in balancing the different noise and echo suppression goals.

The second part will describe how to define post-spatial filter single-channel suppression target, again given a perceptual masking target for residual-echo. The approach, in particular for the echo-suppression part, is driven by a perceptual masking criterion and so differs from many existing approaches, approaches that apply to noise suppression and which look at more mean-square-error or log-spectrum amplitude estimation.

The approach takes into account both noise and residual-echo suppression requirements, and balances both in determining a suppression gain target.

Also described is how to use this suppression target to derive a suppression gain, and practical ways to apply this gain to post-spatial filtered signal (besides simply a direct application).

The third part will describe some options on how to define a non-stationary residual-echo covariance matrix.

In the descriptions that follow, we are describing the operation on scalar and/or "N" dimensional signals which can correspond to signals for a given time interval, frequency bin, or both. For simplicity we will not include notations for time and/or frequency. In general a bold-faced lower-case letter is a N×1 column vector, and a bold-faced capital letter is a N×N matrix.

There are some well-known classic mechanics that are used in aspects of this disclosure. It is also understood that the vector "g" and the matrix $R_{nn}$ can be estimated in ways known in the art.

For example, the noise covariance can be estimated by recursively averaging sample matrices $yy^H$ for areas of time/frequency of signal y where we know no desired speech is present and no residual-echo is present. There are a variety of techniques (e.g. signal processing or neural network based voice activity or echo activity detectors) which can be used to determine whether speech or echo is present, with some tradeoff in false-alarm and missed detection.

To determine if non-trivial residual-echo is present a system can threshold the level of echo estimated by the echo-canceller in the system, or the level of the playback signal (which creates the echo) in the system. The presence can be a ratio between 0 and 1 determined by comparing relative levels of echo-relevant signals to non-echo signals.

For example "g" could be the eigenvector corresponding to the principle eigenvector of an estimated "desired-signal" s (such as speech) covariance matrix $$R_{ss}=E[ss^H].$$

To estimate $R_{ss}$ one technique used is to estimate a total matrix b. $R_{xx}=E[ss^H]+E[nn^H]$ by recursively averaging sample matrices $yy^H$ for areas of time/frequency of signal y where a system knows only desired speech and noise is present (and no residual-echo is present). That is y=s+n. With this, and assuming signal and noise are independent, a system can have an estimate of $R_{ss}$ given by $R_{ss}=R_{xx}-R_{nn}$.

The most basic estimation of matrix $R_{rr}$ follows a similar logic, though an aspect can in general look to something else in the aspect in "Part 3" noted above. But, in the simple estimation one can estimate a matrix $R_{(r+n)(r+n)}=E[rr^H]+E[nn^H]$ by recursively averaging sample matrices $yy^H$ for areas of time/frequency of signal y where we know only noise and residual-echo is present (and no desired speech is present). With this, and assuming residual-echo and noise are independent, a system can have a basic estimate of $R_{rr}$ given by: $R_{rr\text{-}basic}=R_{(r+n)(r+n)}-R_{nn}$.

As a final introductory comment, note that the spatial filter actually uses the inverse of covariance matrices, e.g. $R^{-1}_{uu}$. Calculating an inverse is in general a computationally intensive operation, but there are "fast" techniques to recursively update an inverse given a rank 1 update, like an update with a single "rank-1" product $yy^H$. Such techniques are well known in the art, and not essential for the underlying implementations of aspects of this disclosure. It is simply an implementation option which can be used. This disclosure has also mentioned some options of interest when matrices are rank-1 or rank-2.

However, in general implementations of aspects of this disclosure can be both the original (forward) matrix and the inverse matrix to, for example, drive an adaptive matrix.

Note that sometimes matrices and signals are described without an explicit indexing with respect to time or frequency. But, it should be noted that quantities like y, $R^{-1}_{nn}$, $R^{-1}_{rr}$, $R^{-1}_{vv}$, $R^{-1}_{uu}$, $R_{nn}$, etc. can refer to quantities in a specific frequency bin or band "k", and are quantities that evolve (e.g. change) in time with "t". For some simplicity in this description we will only add such indices when absolutely necessary.

Part 1: Defining the matrix "$R_{uu}$" used in the Spatial Filter.

Interesting aspects of Part 1 include:

Use of an unequal weighting of noise and residual-echo covariances to define $R_{uu}$ that defines the spatial-filter operation.

A perceptually relevant search to decide on this unequal weighing.

Other important aspects:

Definition of a masking level or a masking target based on estimating speech and noise levels; definition of a number of pre and post-spatial filtered signal levels that drive the adaptation; and post-spatial filtered signal levels are also used in driving Part 2, that of the single-channel suppressor.

According to one aspect of an implementation, the matrix $R_{uu}$ can be defined by an unequal positive weighing of individual matrices $R_{nn}$ and $R_{rr}$. It is sufficient to simply consider a weighting factor $0\leq\tau\leq1$ with: $R_{uu}=(1-\tau)R_{nn}+\tau R_{rr}$ where $0\leq\tau\leq1$. This weighting has an implicit model where echo and noise in the original signal are artificially biased. Thus when one creates a spatial filter this bias implicitly means the spatial filter will bias spatial dimensions and weightings to target one type of signal more than the other. However, in doing so one has to consider how these signals couple not just in power but spatially. This is where the use of this form of $R_{uu}$ can be advantageously be used by a system.

The value τ (tau) is adaptive and balances the use of spatial dimensions in the suppression of noise and residual-echo in a way which drives towards the most important goal, in at least some aspects of this disclosure, of rendering residual-echo imperceptible while also reducing noise. For example:

When τ=0 the spatial filter is a MRC operation is entirely focused on noise.

When τ=1 the spatial filter is a MRC operation is entirely focused on residual-echo.

When τ=0.5 a system treats the noise and residual-echo as a single noise signal v=n+r as described above where the SNR, which is really a "Signal" to "Total noise+residual-echo" ratio achieved is optimal if echo and noise are uncorrelated.

The system knows g, and $R_{nn}$, $R_{rr}$ and $R_{vv}$, and $R^{-1}_{nn}$, $R^{-1}_{rr}$, $R^{-1}_{vv}$, and keeping track of these as the system is presented with more inputs y as described in the background.

A system can define a number of post-spatial filtered levels as a function of τ.

Slev(τ): Post-spatial filtered signal level as a function of T.

Nlev(τ): Post-spatial filtered noise level as a function of T.

Rlev(τ): Post-spatial filtered residual-echo level as a function of T.

The system can immediately calculate three of these values for each level.

$$\text{Slev}(0)=\text{Slev}(0.5)=\text{Slev}(1.0)=\alpha^2\sigma^2$$

Nlev(τ):

$$\text{Nlev}(0)=\alpha^2\{g^H R_{nn}^{-1} g\}/\lambda_{nn}.$$

$$\text{Nlev}(0.5)=\alpha^2\{g^H R_{vv}^{-1} R_{nn} R_{vv}^{-1} g\}/\lambda_{vv}^2.$$

$$\text{Nlev}(1.0)=\alpha^2\{g^H R_{rr}^{-1} R_{nn} R_{rr}^{-1} g\}/\lambda_{rr}^2.$$

Rlev(τ):

$$\text{Rlev}(0)=\alpha^2\{g^H R_{nn}^{-1} R_{rr} R_{nn}^{-1-1} g\}/\lambda_{nn}.$$

$$\text{Rlev}(0.5)=\alpha^2\{g^H R_{vv}^{-1} R_{rr} R_{vv}^{-1} g\}/\lambda_{vv}^2.$$

$$\text{Rlev}(1.0)=\alpha^2\{g^H R_{rr}^{-1} g\}/\lambda_{rr}^2.$$

We know in general there is a monotonic aspect in that:

$$\text{Nlev}(0)\leq\text{Nlev}(0.5)\leq\text{Nlev}(1.0)$$

$$\text{Rlev}(0)\geq\text{Rlev}(0.5)\geq\text{Rlev}(1.0)$$

Practically a system can calculate the values for any τ using $$R_{uu}(\tau)=(1-\tau)R_{nn}+\tau R_{rr}$$

$$\lambda_{uu}^2(\tau)=g^H R_{uu}^{-1}(\tau) g$$

$$\text{Slev}(\tau)=\alpha^2\sigma^2$$

$$\text{Nlev}(\tau)=\alpha^2\{g^H R_{uu}^{-1}(\tau) R_{nn} R_{uu}^{-1}(\tau) g\}/\lambda_{uu}^2(\tau)$$

$$\text{Rlev}(\tau)=\alpha^2\{g^H R_{uu}^{-1}(\tau) R_{nn} R_{uu}^{-1}(\tau) g\}/\lambda_{uu}^2(\tau)$$

To lower complexity the system can pick a few τ other than 0.0, 0.5, 1.0. Or, the system can do a simplification and interpolate (linearly or otherwise) between the three values to estimate other values. Or we can limit the choices only to these 3 values. This option has the advantage that we know all the required forward and inverse matrices.

A final option, useful when these operations are done in different frequency components (i.e. all equations and functions previously noted are a function of frequency) is to do this calculation for some sampling of frequency bins or band and then apply the $\tau$ selected to neighboring frequencies.

Option 1 for Choosing $\tau$ Tau

In a system according to an aspect of this disclosure, post-processed levels of signal and noise are the components that mask residual-echo. For these three $\tau$ values we can immediately assess the ratio of these levels. The "PostRatio" is defined by:

Elev($\tau$)=Slev($\tau$)+Nlev($\tau$): This is the non-echo portion of the post filtered signal.

$$\text{PostRatio}(\tau)=\text{Elev}(\tau)/\text{Rlev}(\tau)$$

If we consider our signal values to be a function of frequency, so each of Slev, Nlev, Rlev, are values for a frequency index or band, we can consider masking principles.

In general frequency domain masking is achieved by a ratio that can be 6 to 20 dB in value. The component we consider the masker of echo drives the energy value Elev($\tau$) in the numerator. The signal being masked, the echo in our case, is the energy of the Rlev($\tau$) signal (residual-echo) in the denominator.

A simple embodiment of the system has a fixed target ratio, e.g. 10 dB, for this operation. We then consider $\tau$ values that get close to that ratio. If many achieve or exceed that ratio we pick the $\tau$ closest to 0.5.

One example is shown in FIG. 1 for some assumed covariance matrices. Here the noise and echo covariances are not uncorrelated, and do interact in spatial dimensions.

We see that the total noise "Nlev+Rlev" is minimized near $\tau$=0.5 (though it does not have to be always the case). We also see that as $\tau$ increases, weighing more the echo covariance, the post-spatial filtered noise also tends to increase, reaching to almost the level of post-spatial filtered desired signal level Slev. In fact, at this point the action of $R_{uu}(1.0)$ amplifies the noise.

If we used the 10 dB target on this example one can see that values $\tau \geq 0.7$ all achieve this target. Here we balance multi-channel MRC operation in favor of scaling down residual-echo, to about −1 dB, while getting some suppression of noise down to about 2 dB. Note, the original total noise power as seen through the beamforming vector g, with no MRC matrix $R^{-1}_{uu}$, would be about 10 $\log_{10}(g^H R_{nn} g)$=4 dB. The total echo power as seen through the beamforming vector g, with no MRC matrix $R^{-1}_{uu}$, would be about 10 $\log_{10}(g^H R_{rr} g)$=3.2 dB. So the MRC operation has succeeded in reducing both levels while balancing things in favor of masking echo.

A more advanced implementation for choosing tau considers more carefully the masking aspect of a system. There are two aspects:

a) What is the required ratio, i.e. how much masking is there.

b) The use of adjacent frequency bins/bands in masking.

On the required ratio, if Slev($\tau$) is much greater than Nlev($\tau$), then the masking target is probably closer to 20 dB. This is because speech can be dominated by "tonal" elements which mask other signals (like narrowband noise) less.

If Nlev($\tau$) is much greater than Slev($\tau$), then the masking target is probably closer to 6 dB. This is because noise can be dominated by "non-tonal" elements which mask more, A system can make the assumption that the signal to be masked, the residual-echo, is mostly tonal (at least the residual-echo which is recognized as such), or mostly noise-like, or something in between.

At the end we have two extreme values, one for desired speech masking residual-echo, and one for noise masking residual echo. The procedure is then to interpolate between the two extremes depending on the proportion of speech and noise in y.

One example of this is a linear function in the dB domain. An example interpolating between 6 dB and 15 dB is:

$$\text{Elev}(\tau)=\text{Slev}(\tau)+\text{Nlev}(\tau)$$

$$\text{MaskOffsetIndB}(\tau)=-6+(6-15)\text{Slev}(\tau)/\text{Elev}(\tau)$$

But there are other functions, e.g. estimating tonality of y. All of these options can be used in various implementations of aspects in this disclosure. We now consider the masking signal including additional frequency bins.

As noted earlier, Elev, Slev, Nlev, and Rlev can be also a function of a frequency index. In the prior descriptions we do not use this index so as to simplify the description, but we will use it now for describing a process called spreading.

Let us call this frequency index "k". Thus we have in reality a number of different values over frequency as a function of k, and so really the following quantities are a function of both k and $\tau$ as in:

$$\text{Slev}(\tau,k),\text{Nlev}(\tau,k),\text{Elev}(\tau,k),\text{Rlev}(\tau,k),\text{MaskOffset-IndB}(\tau,k)$$

These values also evolve over time, indexed by say "t", but we do not add this to the notation to keep things simple.

We can consider a spread of the masker energy over frequency Elev($\tau$,k) defined by a weighted combination of such values over frequency. This weighting is known as a spreading function which ideally follows the shape of Cochlear filters in the inner ear.

We have a spreading function Spread(k,j), where "k" is the center frequency where this function applies, and j is the auxiliary index used in convolution. Simply put we could write (fixing $\tau$):

$$\text{SpreadLevIdeal}(\tau,k)=\text{sum}_{j=1,\ldots,N}\text{Spread}(k,j)\text{Elev}(\tau,j)$$

In reality, at this point in the algorithm a system does not know the "$\tau$" selected by neighboring bands "j≠k", and the spread signal can be used to determine masking and thus help us choose $\tau$. Thus above equation SpreadLevIdeal ($\tau$,k)=$\text{sum}_{j=1,\ldots,N}$ Spread(k,j)Elev($\tau$,j) cannot be calculated directly.

However, we know that Slev($\tau$,k) is really not a function of $\tau$. So a possible way around this is to ignore the noise portion of Elev($\tau$,k) in neighboring bands, and calculate a corresponding value SpreadLev($\tau$,k).

We then can define a masking level as a function of $\tau$. Here masking has an additional advantage of considering adjacent frequency components in masking.

$$\text{MaskOffset}(\tau,k)=10^{MaskOffsetindB(\tau,k)/10}$$

$$\text{MaskLev}(\tau,k)=\text{MaskOffset}(\tau,k)\times\text{SpreadLev}(\tau,k)$$

For a given $\tau$ we can then define the level of unmasked residual-echo. This can be done a few ways:

a) Unmasked Echo Energy:

$$\text{UEE}(\tau)=\max(0,\text{Rlev}(\tau)-\text{MaskLev}(\tau)).$$

b) Perceptually Weighted Unmasked Residual-echo Energy: PWUEE(τ). This can use a number of known models for the loudness of an unmasked signal. The perceptually weighted version allows for a softer decision process since it allows for the adjacent bins to help in masking.

For the choice used in the embodiment, the system then chooses the τ that minimizes the unmasked echo energy.

Note, as τ moves to 0.0 noise tends to be suppressed more and residual-echo less. In addition the masking level decreases as both Elev(τ)=Slev(τ)+Nlev(τ) and the proportion of signal having the best masking power of 6 dB decrease.

As τ moves to 1.0 noise is suppressed less and residual-echo more. In addition the masking level increases as Elev(τ)=Slev(τ)+Nlev(τ) increases as does the proportion of signal having the best masking power of 6 dB.

Figure 2:
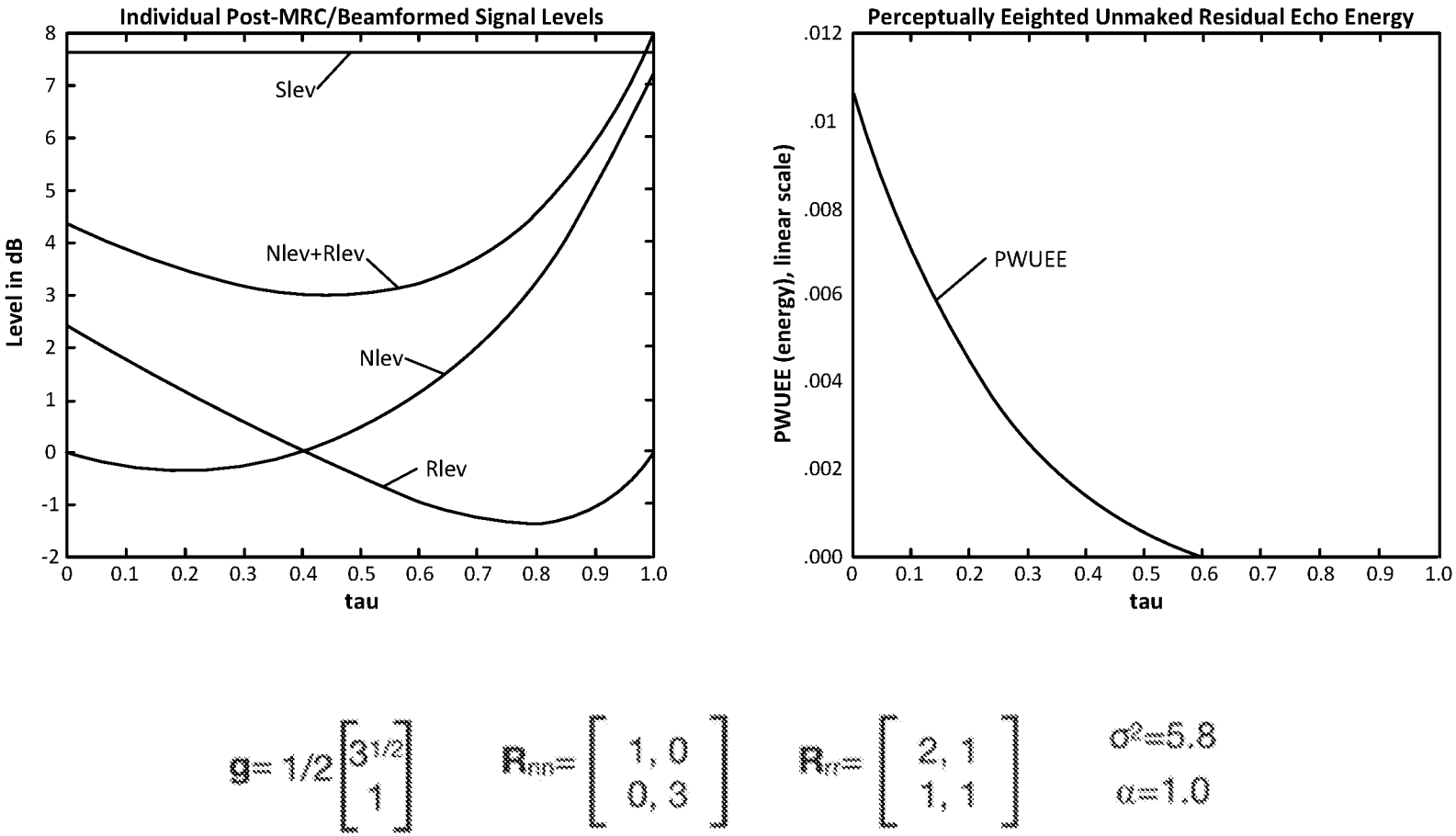
FIG. 2 shows two graphs that depict another method for selecting a value (tau) for controlling the balance between noise and echo suppression according to another aspect described herein.

As an example, we take the case of FIG. 1, and roughly assume the signal is smooth in frequency so that SpreadLev (τ,k)~2.5×Elev(τ,k) at our frequency "k" of interest. The result is shown in FIG. 2. Here the optimal τ moves lower to τ~0.6 since the system accounts for the fact there is more helping to mask the residual-echo. At this point the noise has about 1 dB more MRC-based suppression than at τ~0.7, at the expense of a slight increase in post-MRC levels of residual echo.

What this example is included to show is that in some embodiments the "Perceptually Weighted Unmasked Residual-echo Energy" or "Unmasked Echo Energy" actually hits zero for a range of T. This means that if we did not additionally suppress (the next step in the process described in Part 2 below) we would have actually achieved in principle the target of having residual-echo rendered effectively imperceptible in this frequency bin. This is good for at least some aspects. Furthermore we are able to choose a lower τ which means we are able to suppress more noise.

We have defined various signal levels but it important to stress that the output of the first spatial filtered operation is a single channel defined by:

$$R_{uu}(\tau_{opt})=(1-\tau_{opt})R_{nn}+\tau R_{rr}$$

$$\lambda_{uu}(\tau_{opt})=g^{H}R_{uu}^{-1}(\tau_{opt})g$$

$$h_{mb}=R_{uu}(\tau_{opt})g/\lambda_{uu}(\tau_{opt})$$

$$y_{out}=h^{H}_{mb}y$$

It is for this output that the various quantities like Rlev ($\tau_{opt}$), Slev($\tau_{opt}$), Nlev($\tau_{opt}$) correspond.

On the options described to select τ, if there are many choices that achieve the same value or meet the same target level, e.g. Rlev(τ)<MaskLev(τ) for a number of τ and thus 0 is achieved for those values, then a system can pick the τ value closest to an equal weighting of 0.5. For example, if values τ=0.6 to 1.0 all achieve 0, then a system can pick $\tau_{opt}$=0.6. This allows a system to move towards a value which treats noise and residual-echo more equally, and where there is more benefit in a total noise+residual-echo spatial filtered level reduction.

A system can also set a limit on the unmasked energy, and any τ meeting or going below that limit are considered candidates. This may be needed in cases where τ tends to be too high. We can also limit the largest value of τ so as to allow for some minimal spatial (MRC-like) noise suppression.

It is clear that different scenarios will choose different $\tau_{opt}$ values, and that even in a given scenario the value will change as covariance estimates adapt over time. One can apply smoothing to the raw $\tau_{opt}$ values, or limit how much these can change in time. Often these additions will create a more perpetually pleasing effect.

Figure 3:
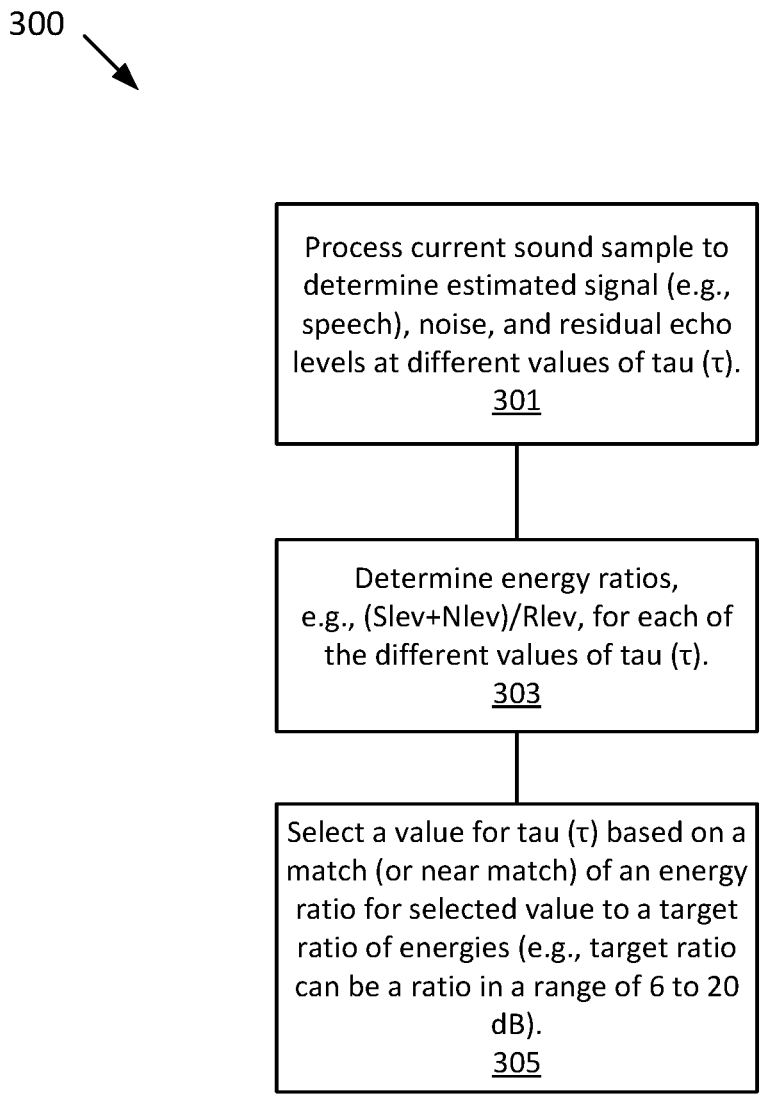
FIG. 3 is a flowchart that shows an example of a method for selecting a value (e.g., tau) for controlling or affecting the balance between noise and echo suppression according to an aspect described herein.

FIG. 3 shows, in flowchart form, a simplified example of a method for selecting a value of tau, where this method operates repeatedly over time and as echo and noise change over time. This method is similar to the technique described above under the heading "Option 1 for Choosing Tau". In operation 301 a system can process a current sound sample to determine estimated signal level (e.g. speech level), estimated noise level, and estimated (residual) echo level at different values of tau (τ), and these three levels can be used in operation 303 to determine "energy" ratios for each of the different values of tau. In one aspect of this disclosure, the energy ratio can be (Slev+Nlev)/Rlev which can be determined as a function of tau. Then in operation 305, a value for tau can be selected based on a match (or near match) of computed (determined) energy ratio for a selected value of tau to a desired or target ratio of energies such as a target ratio in the range of 6 to 20 dB.

Part 2: Defining the Post-Spatial Filtered Scalar Suppression Gains.

Interesting aspects of Part 2 are as follows:

a) Post-spatial filtered level can be derived directly from quantities used/estimated in the skewed MRC and beamforming operation. Thus in this unified system there is no need for an extra estimation step in the Part 2 of the process, though of course in some implementations, a system can always re-estimate single-channel quantities in Part 2 of the process, and even compare the re-estimates to those estimates from Part 1, as a double-check;

b) The masking target offset can also have been set in the skewed MRC and beamforming operation, and can be reused.

One problem addressed in this disclosure is that there is a "chicken and egg" problem in using masking to define suppression as the suppression itself affects signal levels and therefore masking. In some aspects of this disclosure, a system can get around this problem by splitting the frequencies of interest into two subsets: a) A subset "Set No Suppress" of frequencies where there will be no additional signal-channel suppression, and b) a subset of frequencies "Set Suppress" which we will allow suppression. The former set is then used as a reference to define the spread "masker" energies allowing a system to lower-bound a masking threshold.

This split into two subsets has a second aspect which is a potential iterative refinement of this set. For example, if the "no suppression" set is too small, or the net masking level after considering the set can be expanded. This would often mean, implicitly, suppressing the noise less in order to increase the masking level, which is an important option.

While noise suppression targets (the suppression gain driven by these targets) can be derived using classic (conventional techniques known in the art) techniques, such as log-spectra estimation, the suppression target for residual-echo can be set by comparing post-spatial filtered residual-echo energy to masking targets.

Ultimately, a suppression gain may not be applied directly, but can be applied via a biased Wiener filter. This is essentially a "β-adaptive" Parametric Multi-channel Weiner filter.

The spatial filter portion of the system takes N input streams and produces a single output stream $y_{out}$ as defined below.

$$R_{uu}(\tau_{opt})=(1-\tau_{opt})R_{nn}+\tau R_{rr}$$

$$\lambda_{uu}(\tau_{opt})=g^H R_{uu}^{-1}(\tau_{opt})g$$

$$h_{mb}=R_{uu}(\tau_{opt})g/\lambda_{uu}(\tau_{opt})$$

$$y_{out}=h^H_{mb}y$$

Multiple streams can be created by using different a values or different $R_{uu}$ covariance matrices, or both. Various implementations of aspects of this disclosure can handle such multiple streams.

The next operation can be the application of additional suppression to a single output stream $y_{out}$. This is suppression in addition to that by the spatial filter. It can be used to further reduce noise to targets that may have not been achieved by the spatial filter. It may be required if the post-spatial filtered residual-echo is considered "too perceptible".

Here, as in the spatial filter operation, a system can balance these competing requirements.

As noted before many prevailing techniques simplify the model and thus miss the ability to properly differentiate echo and noise, and balance things in favor of the more important requirement of rendering echo imperceptible.

A better result, according to aspects described herein, would be to maintain or improve the balance and exploit masking.

The following description will continue to use the frequency index "k" in quantities, and will drop τ as it is understood this value was set and used in the prior spatial filter operation. However, and so as not to duplicate notation used before, a "m" is added before variables to indicate values at this second stage (Part 2) in the process, e.g. $\text{Slev}(\tau_{opt},k)=\text{mSlev}(k)$.

The spatial filter system used a matrix operation:

$$R_{opt}(k)=(1-\tau_{opt}(k))R_{nn}(k)+\tau_{opt}(k)R_{rr}(k)$$

In this matrix operation, the values "$(1-\tau_{opt}(k))$" and "$\tau_{opt}(k)$" are coefficients that multiply their respective matrix and hence affect the amount of respective noise and echo "suppression". With this the system can determine the expected values of post-spatial filtered levels, now a function of frequency:

$$m\text{Slev}(k)=\alpha^2(k)\sigma^2(k)$$

$$m\text{Nlev}(k)=\alpha^2\{g(k)^H R_{opt}^{-1}(k)R_{nn}(k)R_{opt}^{-1}(k)g(k)\}/\lambda_{uu}^2(k)$$

$$m\text{Rlev}(k)=\alpha^2\{g(k)^H R_{opt}^{-1}(k)R_{rr}(k)R_{opt}^{-1}(k)g(k)\}/\lambda_{uu}^2(k)$$

These are what a system can determine as a-priori levels. See FIG. 1 as an example, where for this particular "k" we are using $\tau_{opt}(k)=0.7$. Here:

mSlev(k) is about 7.75 dB mNlev(k) is about 2.0 dB mRlev(k) is about −1.25 dB

For defining the suppression gain a system can determine what is known as the a-posteriori levels. In particular for an input signal y(k) in the band k there is a quantity which is the total post-spatial filtered signal+noise+echo level:

$$m\text{TotalLev}(k)=\alpha^2|g(k)^H R_{opt}^{-1}(k)y(k)|^2\lambda_{uu}^2(k).$$

A system can estimate the signal only portion of this as $$m\text{ApostSlev}(k)=m\text{TotalLev}(k)-m\text{Nlev}(k)-m\text{Rlev}(k).$$

A system can estimate the signal and noise only portion of this as $$m\text{ApostSandNlev}(k)=m\text{TotalLev}(k)-m\text{Rlev}(k).$$

Figure 4:
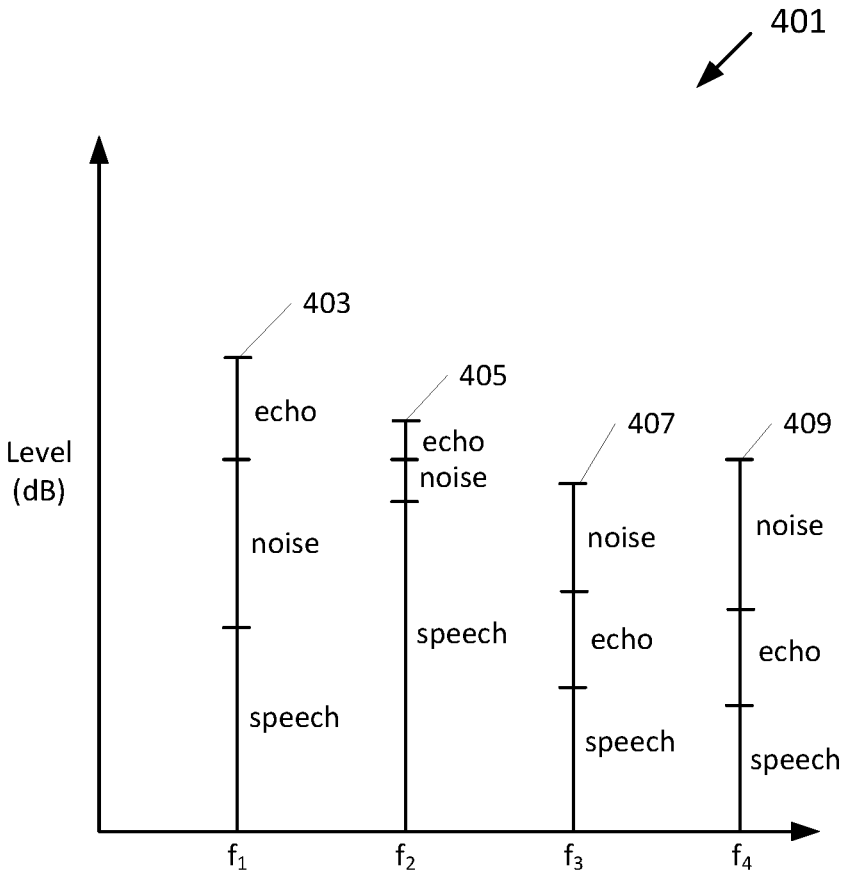
FIG. 4 shows a set of signal levels in a corresponding set of frequency bands that can be used according to an aspect described herein.

An example of how these estimates can be used to obtain relative ratios of signal (e.g., speech), noise, and echo within each frequency band is shown in FIG. 4. The graph 401 shows four frequency bands 403, 405, 407 and 409 along of plot of frequency (on the X axis) versus signal level (on the y axis). The amount of estimated speech, estimated noise, and estimated echo within each frequency band is shown in the graph 401, and it can be seen that frequency band 405 has the least amount of estimated echo and noise relative to estimated speech when compared to the relative levels in the other frequency bands. According to an aspect of this disclosure, a system can determine that frequency band 405 does not need any more suppression and thus masker components in this band can be used as part of the subset that can be leveraged for additional echo and/or noise suppression for at least adjacent frequency bands (such as frequency bands 403 and 407); this aspect is described further below. Frequency band 405 can be in the "Set No Suppress" bins for which no suppression is applied and frequency bands 403 and 407 can be in the "Set Suppress" bins for which some suppression is applied There are many potential options when it comes to setting suppression gains for suppressing noise. One option that can be used is that described by Ephraim and Malah. (See: Ephraim, Y. & D. Malah (1984): Speech enhancement using a minimum mean-square error log-spectral amplitude estimator. IEEE Trans Acoust Speech Signal Proc ASSP-32 (6); December 1984, pages 1109-1121; and Ephraim, Y. & D. Malah (1985): Speech enhancement using a minimum mean-square error short-time spectral amplitude estimator. IEEE Trans Acoust Speech Signal ASSP-33 (2), April 1985, pages 443-445). Here, essentially, the a-posterior level "mApostSandNlev(k)" combine with a-priori levels "mSlev(k)" and "mNlev(k)" to define various SNR values that then combine to define a suppression gain. This is essentially a linear gain applied to suppress noise.

But, there are many other possible gain functions that can be used.

This and other functions often use quantities AprioriSNR(k)=mSlev(k)/mNlev(k) and the instantaneous SNR ApostSNR(k)=mApostSlev(k)/mNlev(k)

As noted, an aspect of this disclosure addresses a problem that arises because masking depends on the signal levels in adjacent frequency bins, yet the signal level in adjacent bins depends on suppression gain.

To practically get around this problem the system can determine a subset of frequency bins for which it knows no additional noise suppression would be applied, and the residual-echo is being masked by the current signal+noise level in that bin without the need for adjacent bins. This is the set "Set No Suppress" as noted before. This can be done by comparing mApostSandNlev(k) and mApostSlev(k) to various thresholds where we are confident post-spatial filtered noise and echo levels are acceptable and sufficiently masked.

The system can then sort the frequency bins into two categories:

a) A set "Set NoSuppress" which are bins for which no suppression is applied (such as frequency band 405 in FIG. 4);

b) A set "Set Suppress" which are the remaining bins (such as frequency bands 403 and 407 and 409).

A system can now form a spectrum which is zero for indices in "Set Suppress", via mENoSuppress(k)=mElev(k) if k is in "Set No Suppress", =0 if k is in "Set Suppress"

A system can now set a spread energy for our masker mENoSuppress(k) to give mSpreadLev(k).

MaskOffset($\tau_{opt}$,k) has been set given the proportion of signal and noise achieved by the post-spatial filter. Let mMaskOffset(k)=MaskOffset($\tau_{opt}$,k) and mMaskLev(k)=MaskOffset(k)×mSpreadLev(k).

If the system determines that "mMaskLev(k)" is much too low, and that it is unlikely that any useful masking could be applied to help mask residual-echo, the system, according to some implementations, has an option to revisit this level. It can do so by changing the criteria for Set No Suppress" and re-evaluating.

A definition of noise suppression gain targets may have essentially been completed in Steps 1 and 2 (Part 2) above, if we use noise suppression gains to determine the set "Set No Suppress".

A system can use conventional noise suppression gain targets. except that the system defines and uses suppression gains <0 dB for bins in the set "Set Suppress".

For example, one option that a system can use is that described by Ephraim and Malah (see citations above).

In another option according to one aspect, a system can define a suppression gain target as:

mNoiseSupGain(k)=0 dB "Set No Suppress" and =(k). A simple and effective method is the scaling that is needed to bring the residual-echo level to the masking level given by $g_{res}$(k)=min(1.0, mMaskLev(k)/mRlev(k)).

Figure 5:
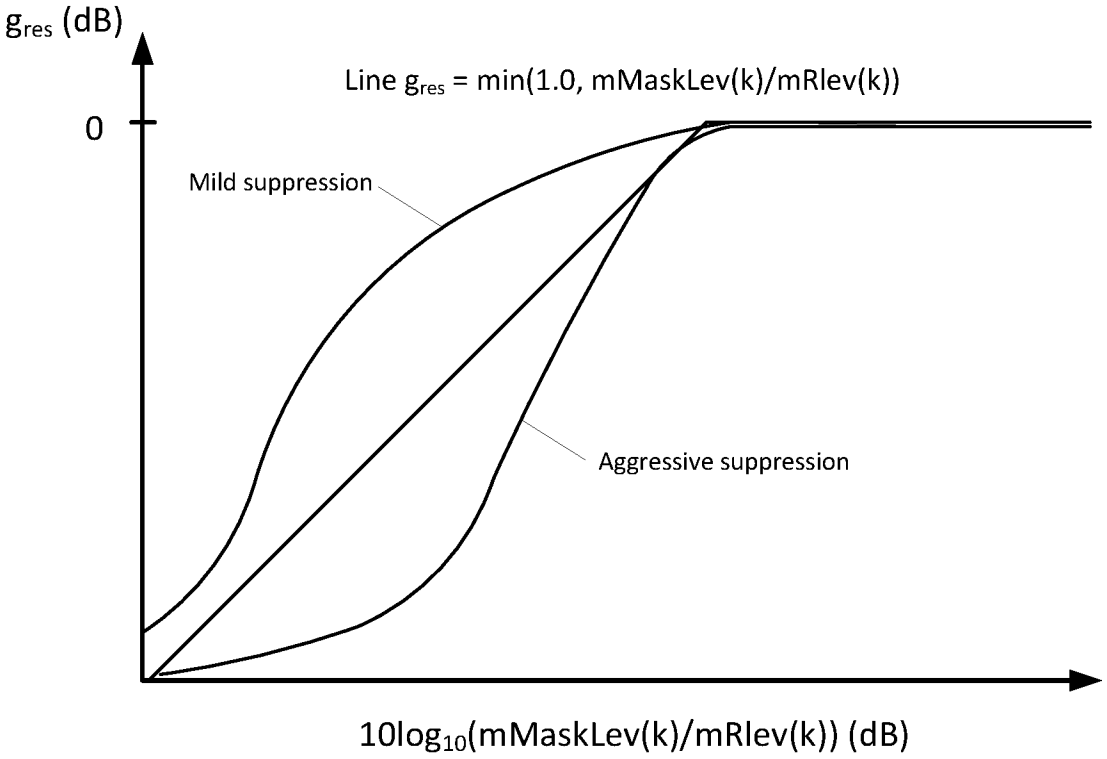
FIG. 5 is a graph that shows examples for setting a residual echo suppression level (gain) as a function of masking and estimated residual echo levels.

As before with the noise suppress gains, a system may threshold at a lower limit, e.g. −50 or −70 dB. A system can also, unlike the noise suppress gains, add an additional scale down, e.g. by −3 dB or so, just to make sure the level goes under the estimated masking level. A system can make the suppression more aggressive or milder, and FIG. 5 shows two examples of how suppression can be varied.

A final aspect of this disclosure notes that the residual-echo covariance matrix may not lend itself to the same type of long-term recursive averaging as the noise covariance matrix. This is because, by definition, the residual echo is strongly dependent on the original echo, which is itself rather non-stationary. So while aspects of the covariance like "spatial direction" (or eigenvectors) may have more long-term meaning, instantaneous aspects such as instantaneous power (and thus eigenvalues) in a band may have less meaning.

Interesting aspects of Part 3 are:

a) A covariance matrix defined by the sum of a more long-term average matrix and a more instantaneous matrix;

b) The instantaneous matrix defined as a function of either the residual echo estimates or playback signals combined with some measure of coherence.

A long-term, heavily smoothed in time, component of $R_{rr}$ can be estimated by long-term averaging as previously described, e.g. by $R_{rr\text{-}basic}=R_{(r+n)(r+n)}-R_{nn}$ A system can also either take the downlink playback signal, or the linear echo estimates from each of the echo cancellers, (referred to as a signal p(k)) and calculate a long-term coherence or leakage "λ(k)" between the power spectrum of p(k) and the power spectrum of y(k) during times when no speech is present (and when the system knows is present). This provides an instantaneous estimate of the power spectrum of the residual echo given by t(k)=λ(k)×power spectrum of p(k).

A system can use one of three options to define the residual echo covariance matrix. One option uses the vector $t(k)=[t_1(k), \ldots, t_N(k)]^T$, and assumes there is no information on phase and computes or determines:

$R_{rr\text{-}instan1}=N\times N$ matrix with diagonal entries $t_1(k), \ldots, t_N(k)$ with $$R_{rr}=R_{rr\text{-}basic}+R_{rr\text{-}instan1}$$

Another option can be based on an assumption or estimate that the spatial signature of the residual-echo is related to that of the original echo, then this option can define $R_{rr\text{-}instan2}=\lambda(k)p(k)p^H(k)$ with $$R_{rr}=R_{rr\text{-}basic}+R_{rr\text{-}instant2}$$

A common option can be applied to either Option 1 or Option 2 and is based upon the nature of residual-echo. Generally, residual-echo levels depend on the playback level of the loudspeaker signal, the very thing that generates the echo. Thus, if there is no playback there is no residual-echo. If playback is of lower volume, or reduces momentarily, so will residual echo. While some of the coherent measures just described naturally take this into account, and thus naturally scale "$R_{rr\text{-}instan1}$" and "$R_{rr\text{-}instan2}$", really such an effect can also change how the system uses $R_{rr\text{-}basic}$ to compute $R_{rr}$.

A system can use a binary flag, or a level between 0 and 1, which can be referred to as a Residual-Echo Activity Detector flag or an Echo Activity Detector Flag (EAD). One such flag is simply formed by the relative level of the linear echo estimate and the echo canceller output signal y(k). Such as:

$$\text{EAD}=\|P(k)\|^2/\|y(k)\|^2$$

A system can refine the two previous options by using this flag to modify the two previous options. For modified Option 1 the value for $R_{rr}$ can be determined as:

$$R_{rr}=\text{EAD}\times R_{rr\text{-}basic}+R_{rr\text{-}instan1}$$

or, for modified Option 2 the value for $R_{rr}$ can be determined as:

$$R_{rr}=\text{EAD}\times R_{rr\text{-}basic}+R_{rr\text{-}instan2}$$

In one implementation, if EAD=0 and p(k)=0, at this extreme a system may set tau (τ)=0 so as to focus only on noise suppression.

Figure 6:
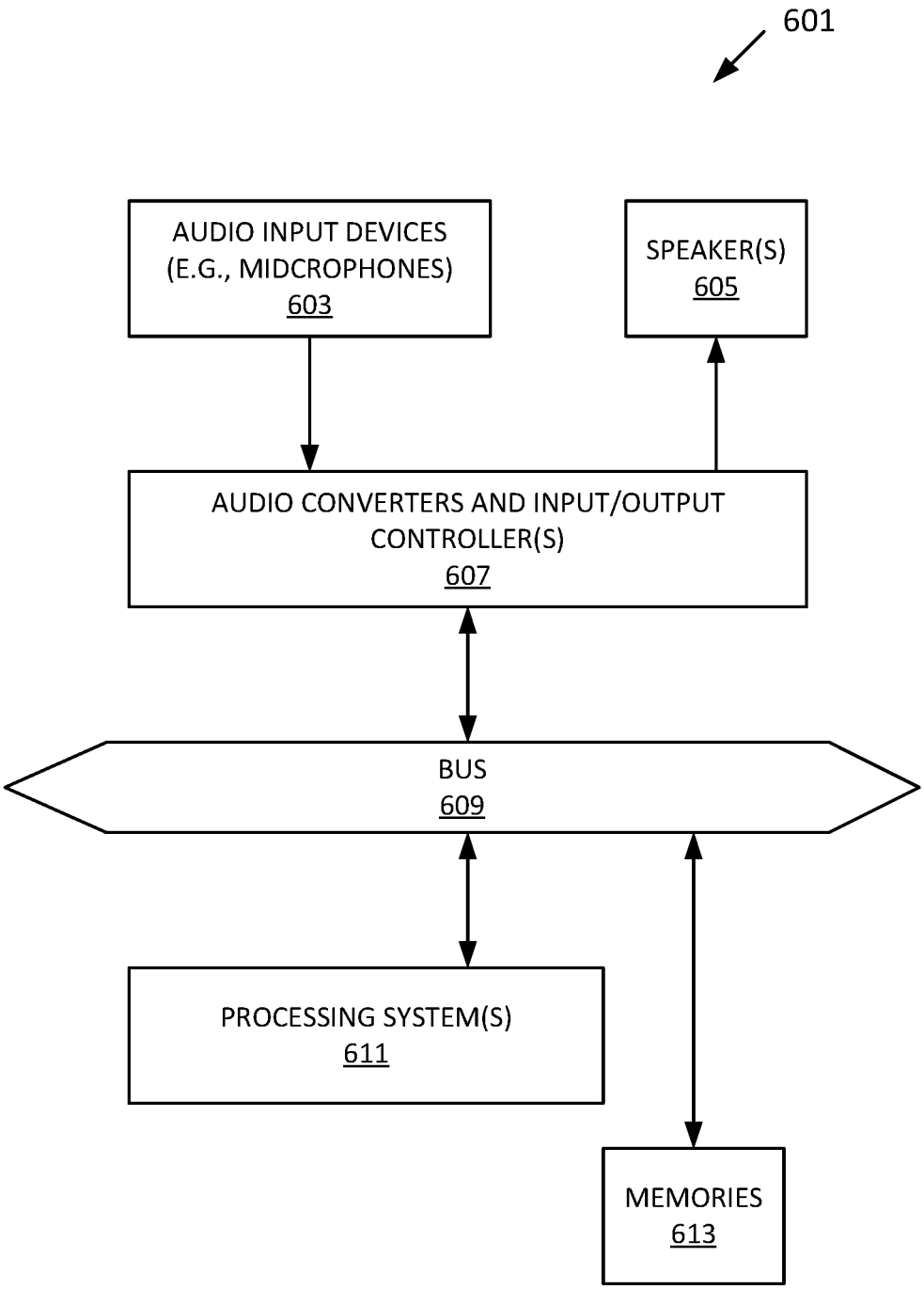
FIG. 6 shows a block diagram of a data processing system that can be used to implement one or more aspects described herein.

The aspects of this disclosure can be implemented in various different systems including smartphones, mobile cellular telephones that are not smartphones, home audio systems (e.g. "smartspeakers") such as HomePod from Apple, Inc. or the Google Home mini or Amazon Echo from Amazon, tablet computer, laptop or desktop computer, car audio systems, game systems, speakerphone systems (e.g. Polycom), wearable systems (e.g. a watch or head mounted display with an audio system) and consumer electronic devices. These various different systems can implement these aspects using general purpose hardware that executes software to perform one or more of the methods described herein or can use special purpose hardware (which may not use software or may use software for some operations) or can use general purpose hardware (programmed with software for some operations) together with special purpose hardware for other operations not performed by the general purpose hardware. FIG. 6 shows an example of a system 601 that can be used to implement any one of the aspects or systems or methods described in this disclosure. The system 601 can include audio input devices 603 which can be a plurality of microphones on the system 601; these microphones can be positioned at different locations on the system 601 to capture sound from different directions. The system 601 can include one or more speakers 605 on the system 601 to output sound, and these speakers can be positioned at different locations. The proximity of the speaker(s) 605 to one or more of the microphones can cause echo such that a far end talker can hear an echo of the far end talker's speech. The audio input devices 603 and the speaker(s) 605 are coupled to audio converters and I/O controllers 607 which are known in the art; the audio converters can include analog to digital (A/D) converter(s) for the microphones and digital to analog (D/A) converters for the speaker(s). The I/O controllers can be conventional input/output controllers to interface the audio components to the rest of the system 601 through, for example, one or more buses 609. The processing system 611, coupled to the one or more buses 609 and coupled to the memories 613, can be a set of processing systems including one or more application processors and a baseband processor (for cellular telephony) and optional dedicated processors (e.g. codecs, secure enclave processors, etc.). The memories 613 can include non-volatile, persistent memory such as flash memory, read-only-memory, and volatile main memory such as DRAM, and these memories can store computer program instructions that when executed can cause one or more of the methods or operations described herein to be performed. The system 601 can also include network interfaces and input/output devices such as touchscreens, etc. The network interfaces can include one or more radios for cellular telephony and/or WiFi networks or other wireless networks. The system can also include special purpose hardware to perform at least some of the operations or methods described herein.

Figure 7:
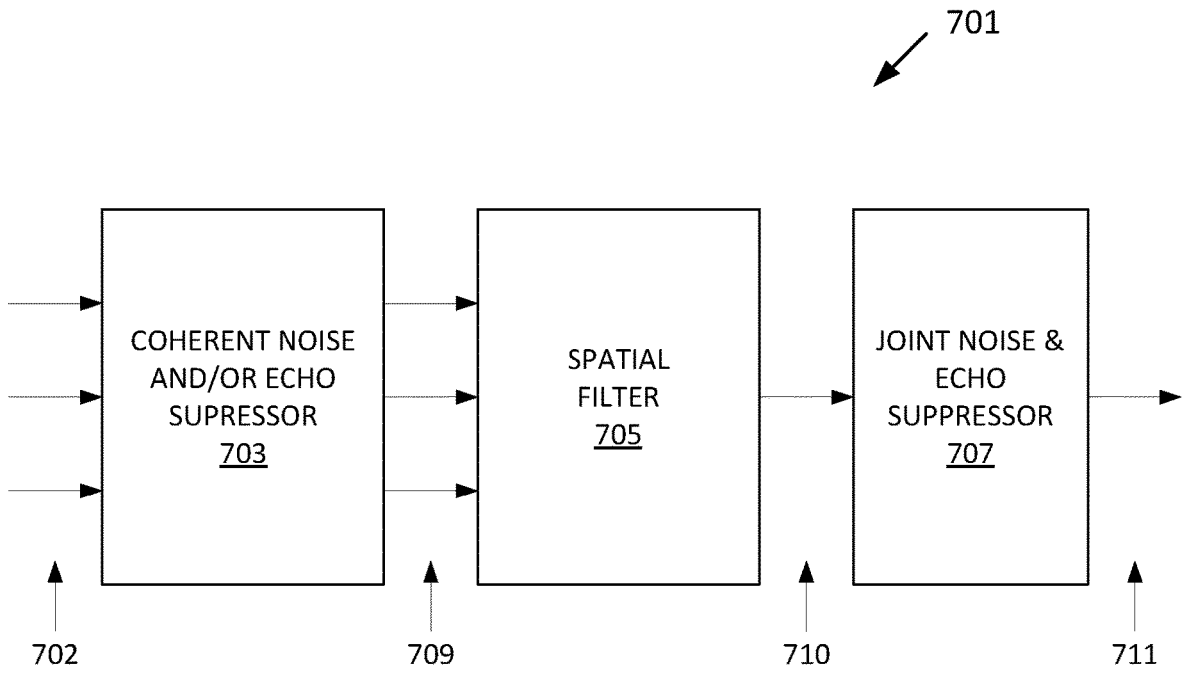
FIG. 7 shows a block diagram of a system that can be used with an audio system to implement one or more aspects described herein.

FIG. 7 shows another example of a system 701 that can be used to implement at least some of the various systems or methods or operations described herein. The system 701 can be part of the system 601 and can be implemented entirely or mostly through software in some aspects; alternatively, most or nearly all can be implemented in special purpose hardware configured to operate as one of the systems described herein or configured to perform the methods or operations described herein. The coherent noise and/or echo suppressor 703 receives a plurality of outputs from a corresponding plurality of microphones (e.g., microphones 603) and suppresses noise and/or echo using known coherent suppression techniques for each of the outputs and provides a set of multichannel signals 709 that are output from the suppressor 703; each of the outputs 709 correspond to one of the outputs from one of the microphones and provides a noise/echo coherently suppressed signal. The spatial filter 705 receives these coherently suppressed signals and can use the spatial filter operations, methods and systems described herein to provide spatial suppression and beamforming that uses adaptively determined coefficients ("tau" and "1-tau") to provide a single channel spatial filtered output 710. The joint noise and echo suppressor 707 can receive the single channel spatial filtered output 710 and provide additional noise and/or echo suppression using the techniques, system, and/or methods described in Part 2 above. The joint noise and echo suppressor 707 can produce a final output 711 that represents the audio signal received from the plurality of microphones with noise and echo suppressed as described herein.

Figure 8:
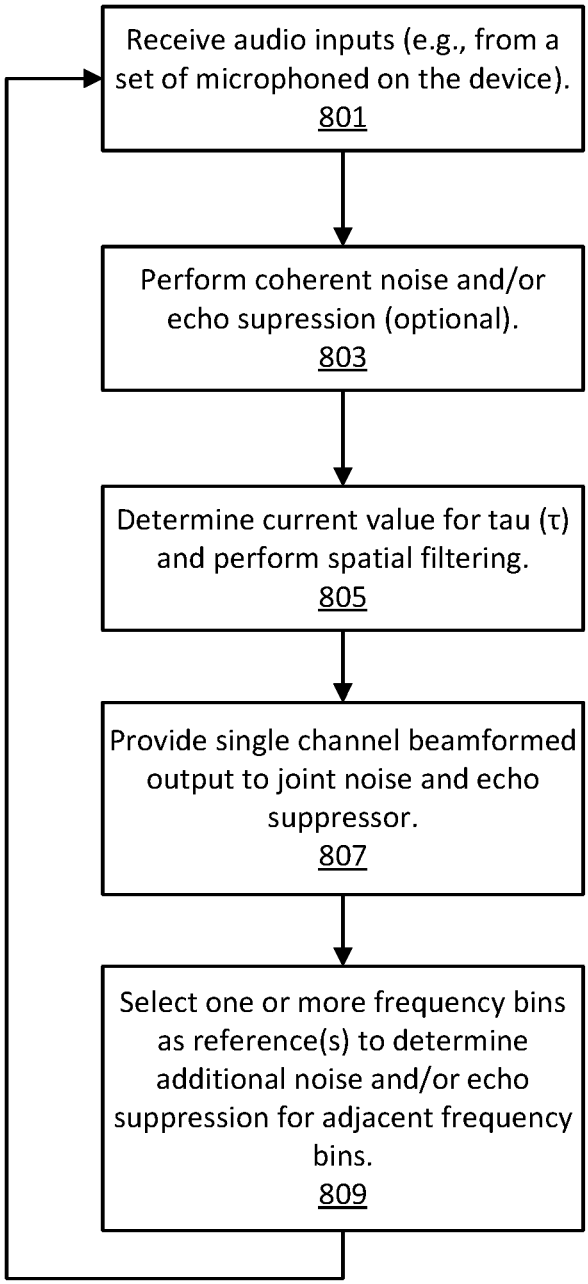
FIG. 8 is a flowchart that shows an example of a method according to one aspect described herein.

FIG. 8 is a flowchart that shows a method according to an aspect described in this disclosure, and this method can be performed with the systems described herein including, for example, the system shown in FIG. 6 or 7. In operation 801, a system receives audio inputs (e.g. from microphones 603). In operation 803, coherent noise and/or echo suppression can be performed (e.g. by suppressor 703 in FIG. 7) on the audio inputs received from the microphones. Then in operation 805, a maximal ratio combining (using an optimal or current value of tau as described above) and beamforming is performed on the multichannel signal to create a spatial filtered single channel signal that is provided in operation 807 to a joint noise and echo suppressor (such as the joint noise and echo suppressor 707). Then in operation 809 one or more frequency bins are selected as one or more references to determine additional noise and/or echo suppression for adjacent frequency bins (such as additional suppression described in Part 2 above); operation 809 can, for example, determine what gain to apply within each frequency bin to preserve masking of echo by a combination of speech and echo. The method then repeats over time and reverts back to operation 801 for the next sample of audio data.

Figure 9:
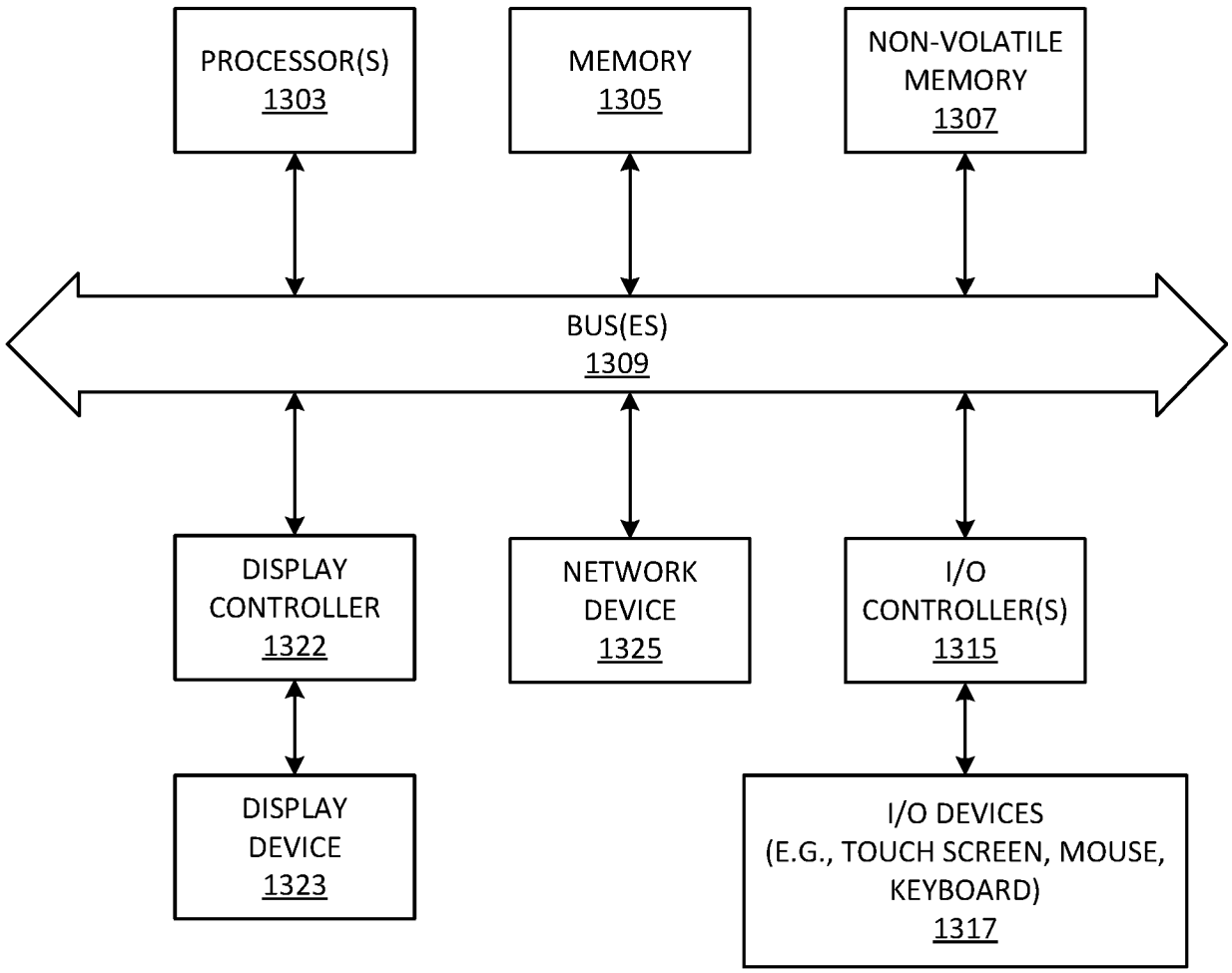
FIG. 9 shows another example of a data processing system that can be used to implement one or more aspects described herein.

FIG. 9 is a block diagram of data processing system hardware according to an aspect. Note that while FIG. 9 illustrates the various components of a data processing system that may be incorporated into a mobile or handheld device or a server system, it is not intended to represent any particular architecture or manner of interconnecting the components as such details are not germane to the present invention. It will also be appreciated that other types of data processing systems that have fewer components than shown or more components than shown in FIG. 9 can also be used with the aspects described in this disclosure. The system in FIG. 9 can include multiple microphones and one or more speakers.

As shown in FIG. 9, the data processing system includes one or more buses 1309 that serve to interconnect the various components of the system. One or more processors 1303 are coupled to the one or more buses 1309 as is known in the art. Memory 1305 may be DRAM or non-volatile RAM or may be flash memory or other types of memory or a combination of such memory devices. This memory is coupled to the one or more buses 1309 using techniques known in the art. The data processing system can also include non-volatile memory 1307, which may be a hard disk drive or a flash memory or a magnetic optical drive or magnetic memory or an optical drive or other types of memory systems that maintain data even after power is removed from the system. The non-volatile memory 1307 and the memory 1305 are both coupled to the one or more buses 1309 using known interfaces and connection techniques. A display controller 1322 is coupled to the one or more buses 1309 in order to receive display data to be displayed on a display device 1323. The display device 1323 can include an integrated touch input to provide a touch screen. The data processing system can also include one or more input/output (I/O) controllers 1315 which provide interfaces for one or more I/O devices, such as one or more mice, touch screens, touch pads, joysticks, microphones and other input devices including those known in the art and output devices (e.g. speakers). The input/output devices 1317 are coupled through one or more I/O controllers 1315 as is known in the art.

While FIG. 9 shows that the non-volatile memory 1307 and the memory 1305 are coupled to the one or more buses directly rather than through a network interface, it will be appreciated that the present invention can utilize non-volatile memory that is remote from the system, such as a network storage device which is coupled to the data processing system through a network interface such as a modem or Ethernet interface. The buses 1309 can be connected to each other through various bridges, controllers and/or adapters as is well known in the art. In one embodiment the I/O controller 1315 includes one or more of a USB (Universal Serial Bus) adapter for controlling USB peripherals, an IEEE 1394 controller for IEEE 1394 compliant peripherals, or a Thunderbolt controller for controlling Thunderbolt peripherals. In one embodiment, one or more network device(s) 1325 can be coupled to the bus(es) 1309. The network device(s) 1325 can be wired network devices (e.g., Ethernet) or wireless network devices (e.g., cellular telephone, WI-FI, Bluetooth).

It will be apparent from this description that aspects of the present invention may be embodied, at least in part, in software. That is, the techniques may be carried out in a data processing system in response to its one or more processors executing a sequence of instructions contained in a storage medium, such as a non-transitory machine-readable storage medium (e.g. DRAM or flash memory). In various embodiments, hardwired circuitry may be used in combination with software instructions to implement the present invention. Thus the techniques are not limited to any specific combination of hardware circuitry and software, or to any particular source for the instructions executed by the data processing system. Moreover, it will be understood that where mobile or handheld devices are described, the description encompasses mobile devices (e.g., laptop devices, tablet devices), handheld devices (e.g., smartphones), as well as embedded systems suitable for use in wearable electronic devices.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

In the foregoing specification, specific exemplary embodiments have been described. It will be evident that various modifications may be made to those embodiments without departing from the broader spirit and scope set forth in the following claims. The specification and drawings are, accordingly, to be regarded in an illustrative sense rather than a restrictive sense.

What is claimed is:

1. A method for processing data, the method comprising:

receiving a multichannel signal representing sound that includes at least one of noise, speech or echo;

determining a first coefficient to suppress echo and a second coefficient to suppress noise, the first coefficient to affect an amount of suppression of echo in the multichannel signal and the second coefficient to affect an amount of suppression of noise in the multichannel signal, the first coefficient and the second coefficient being determined adaptively over time based on the multichannel signal, wherein a sum of the first coefficient and the second coefficient is equal to a constant; and generating a spatial filtered output using the first coefficient and the second coefficient, the spatial filtered output producing a single channel output derived from the multichannel signal, the spatial filtered output suppressing at least one of noise or echo.

2. The method as in claim 1 wherein the method further comprises:

generating a spatial filter that produces the spatial filtered output and wherein the multichannel signal is obtained from a plurality of microphones on a device and the spatial filtered output is a result of a biased maximal ratio combining (MRC) filter that uses the first coefficient and the second coefficient to jointly determine the biased MRC filter which is then used to suppress noise and echo, and wherein the first coefficient and the second coefficient are determined adaptively as noise and echo change over time in an environment that surrounds the device.

3. The method as in claim 2 wherein the first coefficient and the second coefficient are adaptively determined based on a ratio of (1) a sum of an estimated speech signal level and an estimated noise signal level to (2) an estimated echo signal level.

4. The method as in claim 3 wherein the ratio is determined as a function of the first coefficient and the second coefficient, and wherein the first coefficient and the second coefficient are modified based on a comparison of the ratio to a target ratio of signal levels.

5. The method as in claim 4 wherein the target ratio is selected to balance the suppression of echo and noise while retaining some noise to mask echo.

6. The method as in claim 4 wherein a noise suppression target is reduced in low signal to noise ratio conditions to improve echo suppression.

7. The method as in claim 4 wherein the first coefficient is a coefficient that scales an assumed noise covariance matrix and the second coefficient is a coefficient that scales an assumed residual echo covariance matrix.

8. The method as in claim 1, the method further comprising;

determining, for a set of frequency bands, a collection of sound data derived from the spatial filtered output for each of the frequency bands in the set of frequency bands, a first set of sound data for a first frequency band including a first level of estimated noise and a first level of estimated echo and a first level of estimated speech, and a second set of sound data for a second frequency band including a second level of estimated noise and a second level of estimated echo and a second level of estimated speech;

selecting the first set of sound data for the first frequency band for use as a first reference, the selecting based on a comparison of at least one of the first level of estimated noise and the first level of estimated echo relative to the first level of estimated speech; and determining at least one of an additional noise or echo suppression for the second set of sound data for the second frequency band based on the first reference.

9. The method as in claim 8 wherein no additional noise or echo suppression is performed for the first set of sound data for the first frequency band, and wherein the first frequency band is adjacent to the second frequency band in the set of frequency bands.

10. A data processing system comprising:

a plurality of microphones to provide a multichannel signal representing sound that includes at least one of noise, speech or echo;

one or more speakers to output sound;

a processing system coupled to the plurality of microphones and coupled to the one or more speakers;

memory to store executable program introductions which when executed by the processing system cause the processing system to perform a method comprising:

receiving the multichannel signal;

determining a first value to suppress echo and a second value to suppress noise, the first value to affect an amount of suppression of echo for the multichannel signal and the second value to affect an amount of suppression of noise in the multichannel signal, the first value and the second value being determined adaptively over time based on the multichannel signal, wherein a sum of the first coefficient and the second coefficient is equal to a constant; and generating a spatial filtered output using the first value and the second value, the spatial filtered output producing a single channel output derived from the multichannel signal, and the spatial output suppressing at least one of noise or echo.

11. The data processing system as in claim 10 wherein the spatial filtered output is produced at least in part by skewing a formulation of a maximal ratio combining beamformer that uses the first value and the second value, and wherein the first value and the second value are adaptively determined as noise and echo change over time in an environment that surrounds the data processing system.

12. The data processing system as in claim 11 wherein the first value and the second value are adaptively determined based on a ratio of (1) a sum of an estimated speech signal level and an estimated noise signal level to (2) an estimated echo signal level.

13. The data processing system as in claim 12 wherein the ratio is determined as a function of the first value and the second value, and wherein the first value and the second value are determined based on a comparison of the ratio, for a pair of the first value and the second value, to a target ratio of signal levels.

14. The data processing system as in claim 13 wherein the target ratio is selected to suppress echo more than noise, and the target ratio is in a range between minimum and maximum ratio values.

15. The data processing system as in claim 13 wherein the first value is a coefficient that scales an assumed noise covariance matrix and the second value is a coefficient that scales an assumed residual echo covariance matrix, and wherein the assumed noise covariance matrix and the assumed residual echo covariance matrix are used by the skewed maximal ratio combining operation to generate a spatial filter and the spatial filtered output.

16. The data processing system as in claim 15, wherein the method further comprises:

determining, for a set of frequency bands, a collection of sound data derived from the spatial filtered output for each of the frequency bands in the set of frequency bands, a first set of sound data for a first frequency band including a first level of estimated noise and a first level of estimated echo and a first level of estimated speech, and a second set of sound data for a second frequency band including a second level of estimated noise and a second level of estimated echo and a second level of estimated speech;

selecting the first set of sound data for the first frequency band for use as a first reference, the selecting based on a comparison of at least one of the first level of estimated noise and the first level of estimated echo relative to the first level of estimated speech;

determining at least one of an additional noise or echo suppression for the second set of sound data for the second frequency band based on the first reference; and wherein the first frequency band is adjacent to the second frequency band in the set of frequency bands.

17. A non-transitory machine readable medium storing executable program instructions which when executed by a device cause the device to perform a method comprising:

determining, for a set of frequency bands, a collection of sound data derived from a spatial filtered output for each of the frequency bands in the set of frequency bands, a first set of sound data for a first frequency band including a first level of estimated noise and a first level of estimated echo and a first level of estimated speech, and a second set of sound data for a second frequency band including a second level of estimated noise and a second level of estimated echo and a second level of estimated speech, wherein the spatial filter uses a first coefficient and a second coefficient that are adaptively determined based on changing noise or echo levels, and wherein a sum of the first coefficient and the second coefficient is equal a constant;

selecting the first set of sound data for the first frequency band for use as a first reference to determine at least one of noise suppression or echo suppression, the selecting based on a comparison of at least one of the first level of estimated noise and the first level of estimated echo relative to the first level of estimated speech; and determining at least one of a noise suppression or an echo suppression for the second set of sound data for the second frequency band based on the first reference.

18. The medium as in claim 17 wherein the at least one of the noise suppression or the echo suppression is an additional suppression performed after at least one of an echo suppression or a noise suppression by at least one of (1) a skewed maximal ratio combining beamformer and (2) a coherent suppression of at least one of noise and echo.

19. The medium as in claim 18 wherein an additional noise or echo suppression is performed for the set of sound data for the first frequency band which is adjacent to the second frequency band in the set of frequency bands.

* * * * *